US005619005A

United States Patent [19]

Shibukawa et al.

[11] Patent Number: 5,619,005

[45] Date of Patent: Apr. 8, 1997

[54] ELECTRONIC MUSICAL INSTRUMENT CAPABLE OF CONTROLLING TONE ON THE BASIS OF DETECTION OF KEY OPERATING STYLE

[75] Inventors: Takeo Shibukawa; Junichi Mishima, both of Hamamatsu, Japan

[73] Assignee: Yamaha Corporation, Japan

[21] Appl. No.: 365,291

[22] Filed: Dec. 28, 1994

[30] Foreign Application Priority Data

Dec. 28, 1993 [JP] Japan ..... 5-337311

[51] Int. Cl.[6] ..... G10H 1/053; G10H 1/18

[52] U.S. Cl. ..... 84/658

[58] Field of Search ..... 84/615, 626, 633, 84/658, 665, 687–690, 711, DIG. 7

[56] References Cited

U.S. PATENT DOCUMENTS

| | | | |
|---|---|---|---|
| 5,097,741 | 3/1992 | Kikumoto | 84/626 |
| 5,107,748 | 4/1992 | Muramatsu et al. | 84/658 |
| 5,187,315 | 2/1993 | Muramatsu et al. | 84/688 |
| 5,254,804 | 10/1993 | Tamaki et al. | 84/626 |
| 5,260,507 | 11/1993 | Hagino et al. | 84/615 |
| 5,292,995 | 3/1994 | Usa | 84/626 |
| 5,401,898 | 3/1995 | Usa et al. | 84/658 |
| 5,432,295 | 7/1995 | Matsunaga et al. | 84/615 |

FOREIGN PATENT DOCUMENTS 3-67299 3/1991 Japan .

*Primary Examiner*—Stanley J. Witkowski
*Attorney, Agent, or Firm*—Graham & James LLP

[57] ABSTRACT

A detector is provided which generates detection signal that represents a value varying in response to the movement of a key operated on a keyboard. The key operating style employed for the operated key is reflected in subtle, dynamic action occurring in connection with the operated key during depression of the key. For instance, if the key operating style for the operated key has more staccato factor or characteristic, then the action of the operated key will present nonlinear characteristics relatively remarkably. Thus, the key operating style for the operated key can be determined on the basis of time-varying values of the detection signal, and by controlling tone depending on the determined key operating style, it is possible to achieve good-quality tone control, well reflecting subtle differences in key operating styles such as staccato, tenuto and the like, which is difficult to achieve with the conventional touch control techniques.

29 Claims, 17 Drawing Sheets

PERFORMANCE STYLE ANALIZATION CALCULATION (PART 1)

PERFORMANCE STYLE ANALIZATION CALCULATION (PART 2)

NUMBER-OF-TIMES n SETTING PROSESS

CALCULATION OF PERFORMANCE STYLE & VELOCITY DATA (EXAMPLE 1)

THRESHOLD VALUE C SETTING PROCESS

CALCULATION OF VELOCITY DATA (EXAMPLE 3)

ELECTRONIC MUSICAL INSTRUMENT CAPABLE OF CONTROLLING TONE ON THE BASIS OF DETECTION OF KEY OPERATING STYLE

BACKGROUND OF THE INVENTION

The present invention relates generally to electronic musical instruments having a keyboard for performing tone selection or generation, and more particularly to an electronic musical instrument which detects a key opereting or performance style employed for the operated key on the keyboard and controls a tone in response to the detected key operating or performance style.

It is commonly known that characteristics of a tone generated by a natural piano vary depending on a key depression velocity. To approximate such characteristics, electronic musical instruments are generally provided with a transfer switch or a two-make-contact switch of bowl-like shape for each key so as to detect a depression velocity of each operated key.

However, the conventional keyboards having the transfer switch or two-make-contact switch are designed to only detect an average velocity at which a depressed key moves between two points, and thus the key depression velocity is detected as being the same even when the key operating or performance style is changed from one to another. In other words, with the prior technique, differences in key operating styles such as staccato, tenuto and the like can not be reflected in tones to be generated. Key operating style may also be detected using initial-touch and after-touch information, but such an approach to detection key operating style is not necessarily preferable to keyboard musical instruments in that tone generation is appreciably delayed while waiting for after-touch information to be obtained.

In view of the above-mentioned problem, so-called "whole-stroke-sensing keyboards" which are capable of detecting varying stroke positions of a depressed key to thereby achieve finer tone control are proposed in, for example, U.S. Pat. Nos. 5,107,748 and 5,187,315 and Japanese Patent Laid-open Publication No. HEI 3-67299. Each of these proposed keyboards is designed to detect varying key positions throughout the entire stroke of a depressed key.

Further, U.S. Pat. No. 5,292,995 proposes an electronic keyboard musical instrument which performs tone control by the use of preceding depressed key data and after-touch detection information on a preceding depressed key.

However, with the prior art electronic keyboard musical instruments, it is very difficult to change characteristics of tone to be generated by varying key operating styles such as staccato, tenuto and the like. It is also difficult to detect the operating style of a depressed key and generate in real-time a tone signal well reflecting a detected key operating style.

SUMMARY OF THE INVENTION

It is therefore an object of the present invention to provide an electronic musical instrument which is capable of detecting a subtle key operating style employed for a depressed key to allow tone to be controlled on the basis of the detected key operating style.

More specifically, the present invention seeks to provide an electronic musical instrument which can finely distinguish between various key operating styles such as staccato, tenuto and the like, so as to control tone on the basis of control data relating to each distinguished key operating style. In other words, on the basis of an early-stage detection of a key touch at the start of a key operation which was never possible with the conventional initial touch control technique based on detection of an average velocity during key depression, the present invention identifies subtle differences between various key operating styles such as staccato, tenuto and the like and makes good use of the thus-identified differences for tone controlling purposes.

In order to accomplish the above-identified object, the present invention provides an electronic musical instrument which comprises a keyboard including a support member and a plurality of keys provided for pivotal movement relative to the support member, a tone generation section for generating a tone corresponding to any of the keys which is operated on the keyboard, a detection section for generating a detection signal which represents a value varying in response to the movement of the operated key, a performance style determination section for determining a key operating style employed for the operated key, on the basis of time-varying values of the detection signal, and a tone control section for controlling a tone to be generated by the tone generation section, depending on the key operating style determined by the performance style determination section.

Studies of the inventors have identified that subtle, dynamic action occurring in connection with each operated key during depression of the same reflects a specific key operating style employed. For instance, if the key operating style for the operated key has more factors or characteristics of staccato, then the action of the operated key will present nonlinear characteristics in a relatively remarkable degree. Thus, according to this invention, the detection section generates a detection signal which represents a value varying in response to the movement or action of the operated key, so that the performance style determination section is allowed to determine a key operating style employed for the operated key, on the basis of the time-varying values of the detection signal. By controlling tone depending on the determined key operating style, it is possible to achieve good-quality tone control, well reflecting subtle differences in key operating styles such as staccato, tenuto and the like, which was difficult or impossible to achieve with the conventional touch control (simple initial touch control and after-touch control) techniques as discussed above.

According to one preferred form of the present invention, the detection section may include a plurality of stroke sensors provided in corresponding relations to the keys so that each of the stroke sensors detects a position of the corresponding key relative to the support member, and the performance style determination section may include an analyzation section for analyzing a degree of nonlinearity of time-variation in the position detection signal output from each of the stroke sensors so that the determination section determines a key operating style on the basis of the analyzed degree of nonlinearity. Further, the analyzation section may include a velocity calculation section for successively performing calculation to obtain varying current velocities of the operated key on the basis of the position detection signal so that the analyzation section analyzes the degree of nonlinearity on the basis of a time-variation pattern of the current velocities obtained by the calculation. As the detection section, stroke sensors may be used which are provided in corresponding relations to the keys so that each of the stroke sensors detects a position of the corresponding key relative to the support member.

According to the discoveries by the inventors, a certain nonlinear relationship is present between the motion of a portion of the key directly touched by the player's finger (i.e., key top portion), and the action actually felt by the detection section to which the motion is transmitted. In other words, certain linear-nonlinear conversion factors are present between each key and the detection section. As will become apparent from the preferred embodiments and experimental data which will be later described in this specification, if the depressing finger initially contacts the key with a stronger force, the output signal from the detection section will present more nonlinear characteristics. For example, in the case of a staccato performance, because of the operational characteristic that the key is released immediately after depression, force applied at the very beginning of depression tends to be stronger. Accordingly, it is found from experimental observation that if the output signal from the detection section has a greater degree of linearity, such a key operating style with more staccato characteristics will be detected.

According to the inventors' first consideration, the linear-nonlinear conversion factors present between each key and the detection section (e.g., stroke sensor) may comprise one or more of the following four factors that are interlocked in a very complicated manner:

(1) Each key is rigid, but slightly flexes when depressed with a strong force;

(2) A rotation support section between each key and the support member has unevenness when viewed microscopically, and lubricant (grease) is applied to fill the unevenness. This part will slightly move to cause the fulcrum to be displaced;

(3) The mass body moves in an interlocking relation to the corresponding key in the embodiments, and energy accumulates as force is transmitted from a mass body driving section to a mass body driven section of the corresponding key when the key is pressed with a particularly strong force; and (4) Because a gray scale used in each key stroke detecting sensor is in the form of a film having a thickness of about 0.3 mm, the gray scale is subjected to air resistance as the key or mass body moves.

Now, the preferred embodiments of the present invention will be described in detail below with reference to the accompanying drawings.

DETAILED DESCRIPTION OF THE PREFERRED EMBODIMENT

Figure 1:
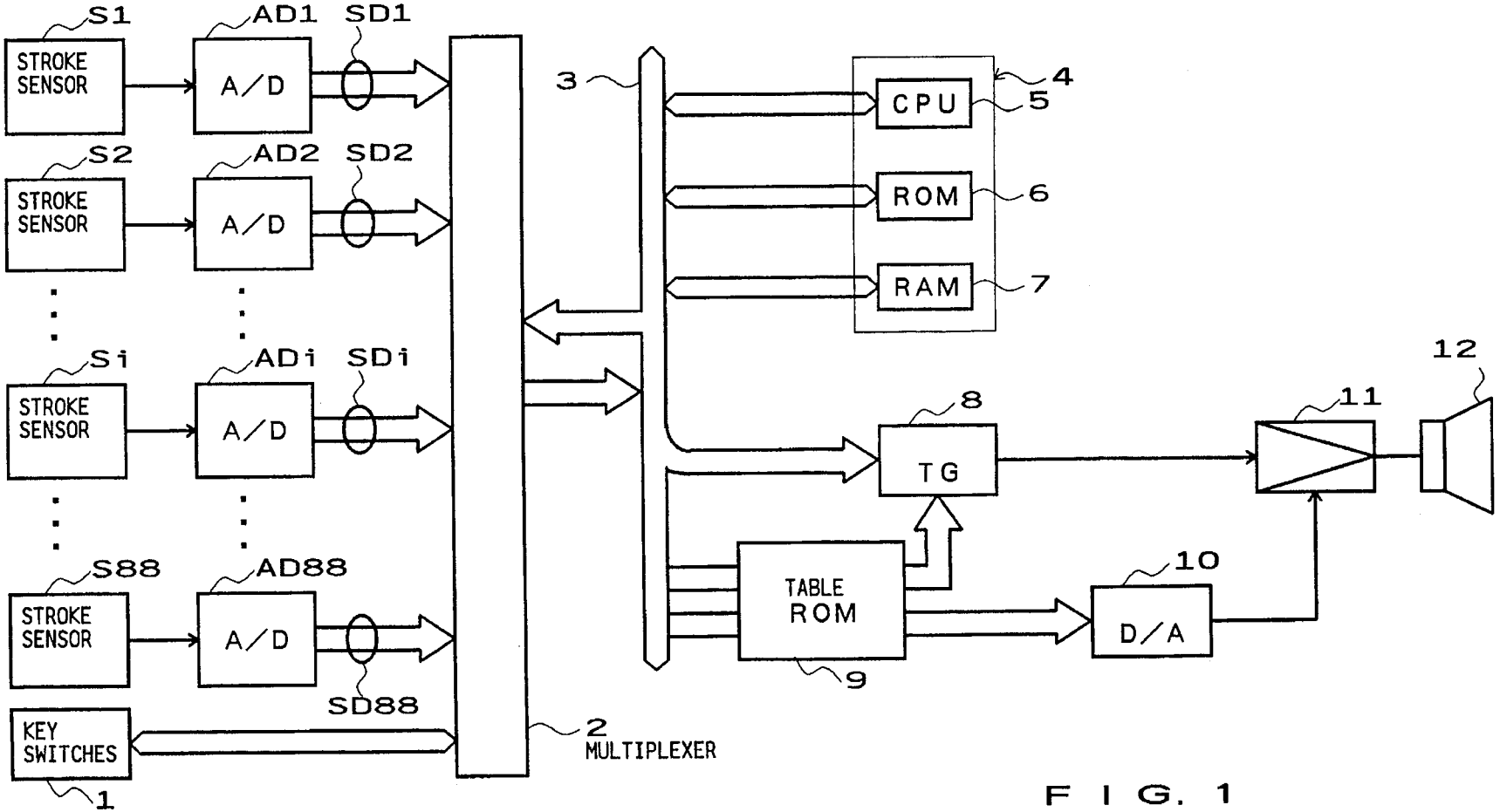
FIG. 1 is a block diagram of a structural example of an electronic musical instrument in accordance with the present invention.

FIG. 1 is a block diagram showing by way of example the structure of an electronic keyboard musical instrument in accordance with an embodiment of the present invention.

A keyboard in the illustrated embodiment has 88 keys and stroke sensors S1 to S88 provided in corresponding relations to the keys. When the player depresses or releases any of the keys, the corresponding stroke sensor detects the stroke position of the depressed or released key. The detected stroke position is converted into a digital signal SD1–SD88 by a corresponding A/D converter AD1–AD88 and is then supplied to a multiplexer 2. Further, key switches 1 supply the multiplexer with tone pitch information and other information relating to the player's operation of each key such as key depression velocity and pressure. The multiplexer 2 passes the supplied information to a bus 3 as necessary.

On an operation panel of the electronic keyboard musical instrument are provided panel switches (not shown) to enable the player to give various instructions such as adjustment of tone volume, selection of tone color, impartment of effect and modulation. Upon the player's operation of any of the panel switches, information representative of the operation is supplied to the multiplexer 2.

A microcomputer 4 comprises a CPU (central processing unit) 5, a ROM (read only memory) 6 and a RAM (random access memory) 7. Arithmetic operation programs are prestored in the ROM 6, in accordance with which the CPU 5 performs various arithmetic operations using working memories such as registers and buffer memories provided within the RAM 7. The microcomputer 4 receives the information relating to the keyboard operation from the multiplexer 2 by way of the bus 3.

When any of the keys is depressed on the keyboard, a first contact of one of two-make-contact key switch corresponding to the depressed key among the key switches 1 is turned ON or activated, and then a second contact of the key switch of the depressed key is turned ON. Once the key is released, the second and first contacts are turned OFF or deactivated successively in the mentioned order. The microcomputer 4 may be designed to detect, as a velocity signal, the reciprocal number of a time between the time point when the first contact is turned ON and the time point when the second contact is turned ON, and then determine fundamental tone signal parameters on the basis of the detected reciprocal number as is conventional with the prior initial touch control techniques.

On the basis of the tone signal parameters provided from the microcomputer 4, a tone source circuit or tone generator 8 creates and outputs a tone signal necessary for tone generation. The output tone signal is amplified by an amplifier 11 and audibly reproduced or sounded via a speaker 12.

Further, the microcomputer 4 detects the movement of each operated key on the basis of the signal from the corresponding stroke sensor S1–S88, so as to detect the key operating style employed for the key such as staccato, tenuto or the like. As is also well known in the art, tenuto is a style to perform while fully sustaining the duration represented by each note, and staccato is a style to perform while clearly separating each tone.

A table ROM 9 prestores tone control amounts of tone volume, tone color, effect, etc. for each of various key operating styles. The microcomputer 4 detects a key operating style on the basis of the movement of each operated key as mentioned earlier and reads out the tone control amounts from the table ROM 9 which correspond to the detected key operating style. The read-out tone control amounts are output to the tone source circuit 8 and amplifier 11. In the tone source circuit 8, tone signal formation based on the signals supplied from the key switches 1 is modified by signals from the table ROM 9 which reflect the key operating style.

The table ROM 9 provides the tone source circuit 8 with the tone control amounts to control the tone color and effect. The table ROM 9 provides a D/A converter 10 with the tone volume control amount to control the amplification factor of the amplifier 11 so that the volume of tone to be sounded via the speaker 12 is changed.

FIGS. 2 to 5 illustrate examples of tone control based on a key operating style determined in accordance with the present invention.

Figure 2:
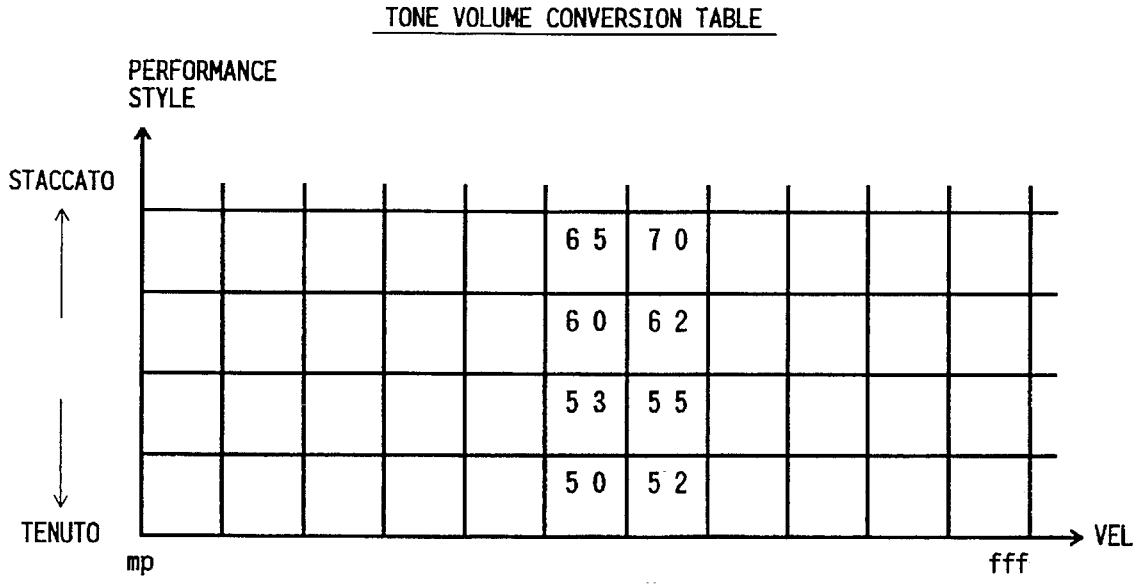
FIG. 2 is a diagram showing an example of a tone volume conversion table preset in a table ROM shown in FIG. 1.

FIG. 2 illustrates an example of a tone control amount prestored in the table ROM 9; more specifically FIG. 2 shows an example of a tone volume control table from which tone control parameter is supplied to the amplifier 11 via the D/A converter 10. In the FIG. 2 table, the horizontal axis represents velocity data VEL, while the vertical axis represents key operating style. The larger values in the vertical axis represent more of staccato characteristics, while the smaller values in the vertical axis represent more of tenuto characteristics.

Each velocity data VEL in the horizontal axis of FIG. 2 may, for example, be detected as the reciprocal number of a time difference between a time point when the first contact is turned ON and a time point when the second contact is turned ON. The velocity data VEL in the table correspond to the magnitude of tone and have a range from mezzo piano (mp) where the data value is smallest, to fortissimo where the data value is greatest. This velocity data VEL can be said to be average or representative velocity data.

According to an embodiment of the present invention, even when the velocity data (average or representative velocity data) resultant from key depressions is constant, the volume of tone to be generated will be controlled in a subtly different style as long as a different key operating style is employed. For example, the control amounts may be preset in the table ROM such that the tone volume increases if the key operating style is a staccato or staccato-like style and the tone volume decreases if the key operating style is a tenuto or tenuto-like style. The volume control parameter read out from the table ROM 9 is sent to the amplifier 11 to control the volume of tone to be generated.

The table ROM 9 prestores various tables for tone color control etc. other than the volume control parameter table as mentioned above. These tables include, for example, coefficient tables of envelope waveforms and tone color parameters where the horizontal axis represents velocity data VEL and the vertical axis represents performance styles. These coefficients are used for controlling various parameters for the tone source circuit 8.

Figure 3:
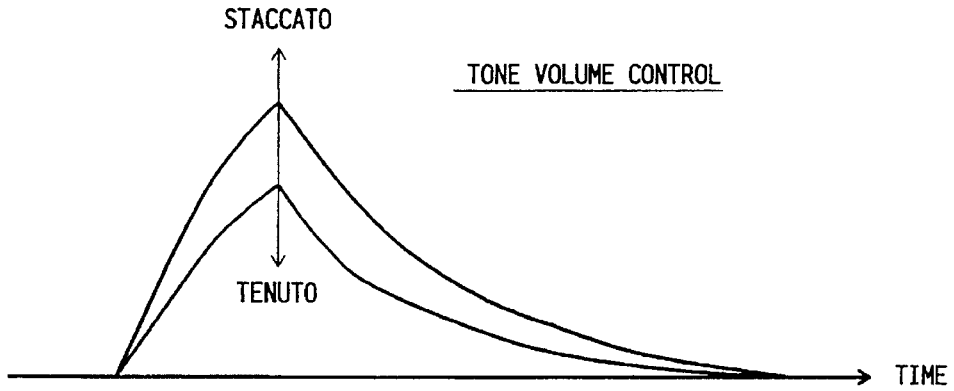
FIG. 3 is a waveform diagram showing waveforms which are volume-controlled by different key operating styles.

FIG. 3 shows examples of envelope waveforms which are volume-controlled depending on a key operating styles employed. Each tone envelope waveform to be controlled by the amplifier 11 is varied depending on which key operating style is employed. Namely, for instance, if the key operating style is staccato, the entire envelope waveform is controlled to increase in amplitude, but if the key operating style is tenuto, the entire envelope waveform is controlled to decrease in amplitude. With such control, relatively great tone volume is achieved with a staccato performance, while relatively small tone volume is achieved with a tenuto performance.

Figure 4:
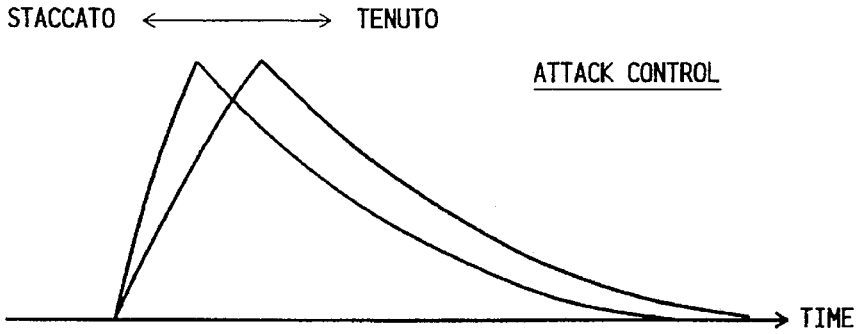
FIG. 4 is a waveform diagram showing waveforms which are controlled in attack portion shape by different key operating styles.

FIG. 4 shows examples of envelope waveforms which are controlled in attack (rise) portion shape depending on a key operating style. The attack shape of each envelope waveform is varied depending on a specific key operating style employed. Namely, for instance, if the key operating style is staccato, the attack shape of the envelope waveform is controlled to be acute, but if the key operating style is tenuto, the attack shape of the envelope waveform is controlled to be gentle. According to such control, tone having a relatively acute attack waveshape is achieved with a staccato performance, while tone having a relatively gentle attack shape is achieved with a tenuto performance.

Figure 5A:
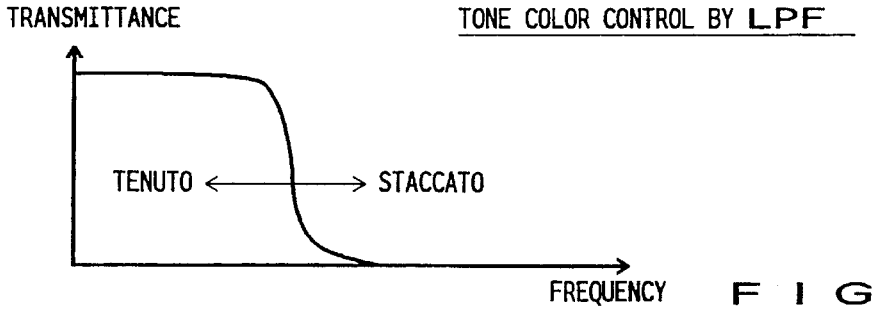
FIG. 5A is a graph showing a frequency characteristic of a low-pass filter (LPF) for tone color control.
Figure 5B:
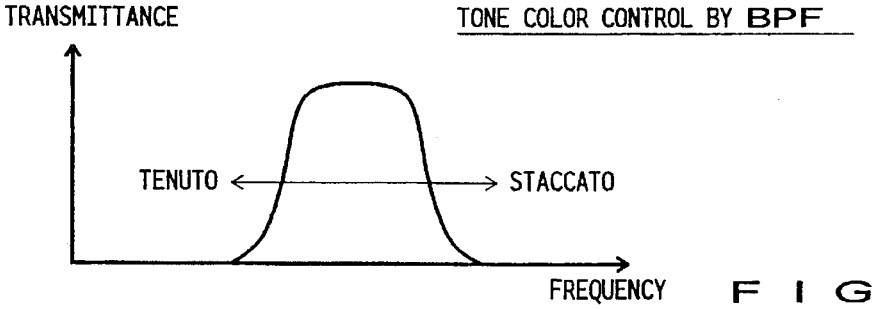
FIG. 5B is a graph showing a frequency characteristic of a band-pass filter (BPF) for tone color control.
Figure 5C:
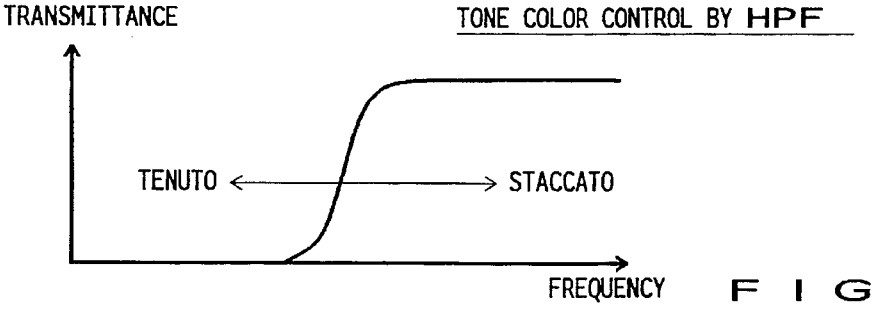
FIG. 5C is a graph showing a frequency characteristic of a high-pass filter (HPF) for tone color control.

Further, FIGS. 5A to 5C shows examples of filter characteristics which are controlled depending on a key operating style employed. Tone color of tone to be generated can be varied by changing the cutoff frequency coefficients of digital filters provided within the tone source circuit 8.

FIG. 5A shows an example characteristic of a low-pass filter (LPF), where the horizontal axis represents frequency and the vertical axis represents signal transmission factors (transmittance). The low-pass filter provides such a characteristic that only signals in the low-frequency region below the cutoff frequency are passed therethrough and signals in the high-frequency region above the cutoff frequency are prevented from being passed therethrough.

FIG. 5B shows an example characteristic of a band-pass filter (BPF), where the horizontal axis represents frequency and the vertical axis represents signal transmittance. The band-pass filter has two cutoff frequencies and allows passage therethrough these signals in the frequency region between the two cutoff frequencies.

Further, FIG. 5C shows an example characteristic of a high-pass filter (HPF), where the horizontal axis represents frequency and the vertical axis represents signal transmittance. The high-pass filter provides such a characteristic that only signals in the high-frequency region above the cutoff frequency are passed therethrough and signals in the low-frequency region below the cutoff frequency are prevented from being passed therethrough.

The three kinds of filters as shown in FIGS. 5A, 5B and 5C each achieve roundish tone color when the cutoff frequency is set low, but achieve bright tone color when the cutoff frequency is set high. Thus, such control is performed that roundish tone color is achieved with a tenuto performance and bright tone color is achieved with a staccato performance.

Before explaining determination or analysis of a key operating style according to the principle of the present invention, an explanation will be made on measurements of timewise stroke position variations in the individual key operating styles with reference to FIGS. 6 to 9.

Figure 6:
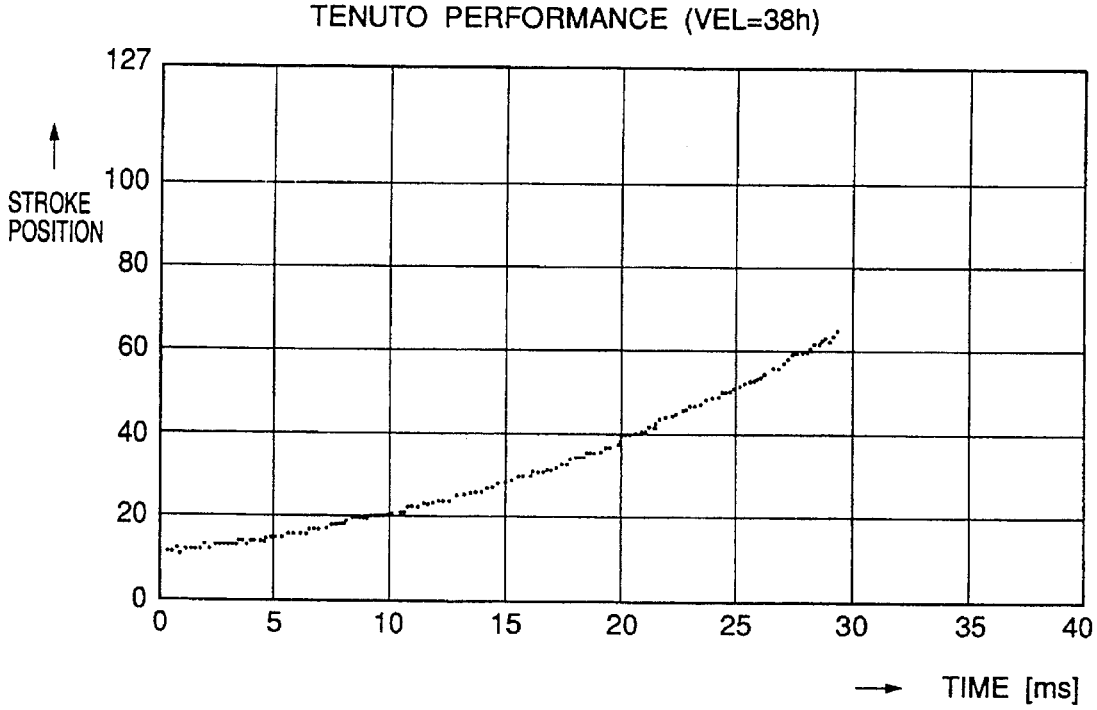
FIG. 6 is a graph showing an example of analysis of a key operating style based on detection of varying stroke positions, and more particularly showing measurements of the varying stroke positions in a tenuto performance when velocity data VEL=38 (hexadecimal)

FIG. 6 is a graphic representation showing measurements of varying stroke positions in a tenuto performance when the velocity data VEL is of small value. A tenuto performance when the velocity data VEL has a value of 38 (hexadecimal) can be said to have a small velocity data value and hence may be a performance made with a weak key touch. The graph of FIG. 6 shows stroke positions varying with the lapse of time. The stroke positions vary smoothly in a downwardly convex curve with the lapse of time. According to Newton's law, if a given force is applied to a given material article, the speed of the particle increases linearly .with time and the position of the particle varies in second function. It may therefore be surmised from the variation that, although the key motion undergoes some resistance etc., the downwardly convex variation allows relatively stable force to act on the key.

Figure 7:
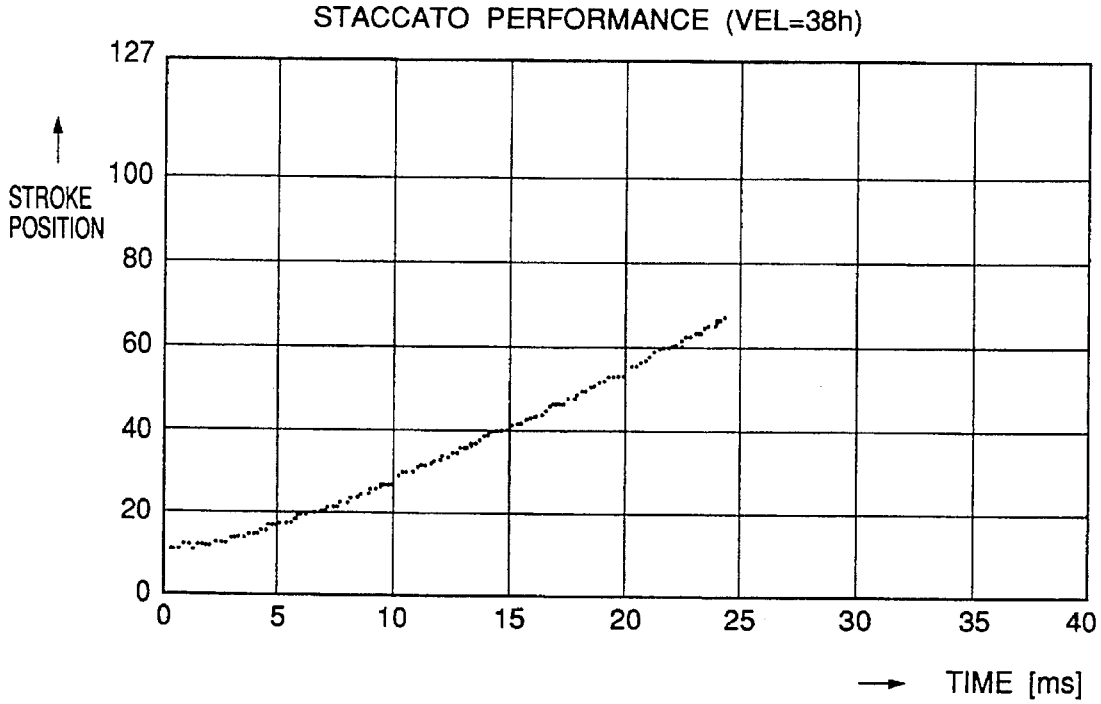
FIG. 7 is a graph showing another example of analysis of a key operating style based on detection of varying stroke positions, and more particularly showing measurements of the varying stroke positions in a staccato performance when velocity data VEL=38 (hexadecimal)

FIG. 7 is a graphic representation showing a stroke position variation occurring in a staccato performance when the velocity data VEL is of small value. Similarly to FIG. 6A, FIG. 7 shows a stroke position variation with time in a staccato performance where the velocity data VEL has a value of 38 (hexadecimal). The stroke position vary smoothly in a downwardly convex curve with time, but vary linearly after a predetermined time has passed. It may be surmised from the variation that the force acting on the key decreases midway due to some reason.

FIGS. 6 and 7 both show graphic representations about performances made by relatively weak key touch. If tenuto and staccato performances are compared, a slight difference can be found, but in effect no great difference exists. However, an outstanding difference may arise if the respective performances are made with relatively strong key touch as will be described below.

Figure 8:
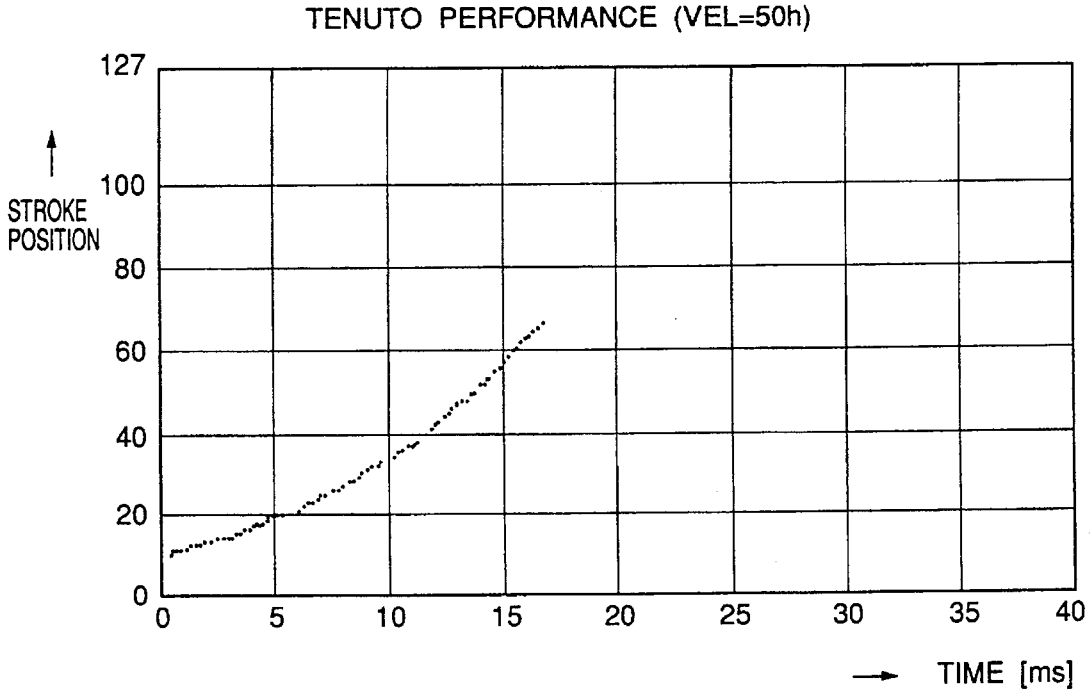
FIG. 8 is a graph showing another example of analysis of a key operating style based on detection of varying stroke positions, and more particularly showing measurements of the varying stroke positions in a tenuto performance when velocity data VEL=50 (hexadecimal)

FIG. 8 is a graphic representation of measurements of varying stroke positions in a tenuto performance when the velocity data VEL is of large value. A tenuto performance with the velocity data VEL having a value of 50 (hexadecimal) can be said to have a large velocity data value and hence is a performance made with stronger key touch than in the tenuto performance of FIG. 6. The graph of FIG. 8 shows stroke positions varying with the lapse of time. The stroke position varies smoothly in a downwardly convex curve with the lapse of time, but at a faster speed than in the tenuto performance of FIG. 6 made with weak key touch. In this case, the active force increases and there will be an increase in the velocity.

Figure 9:
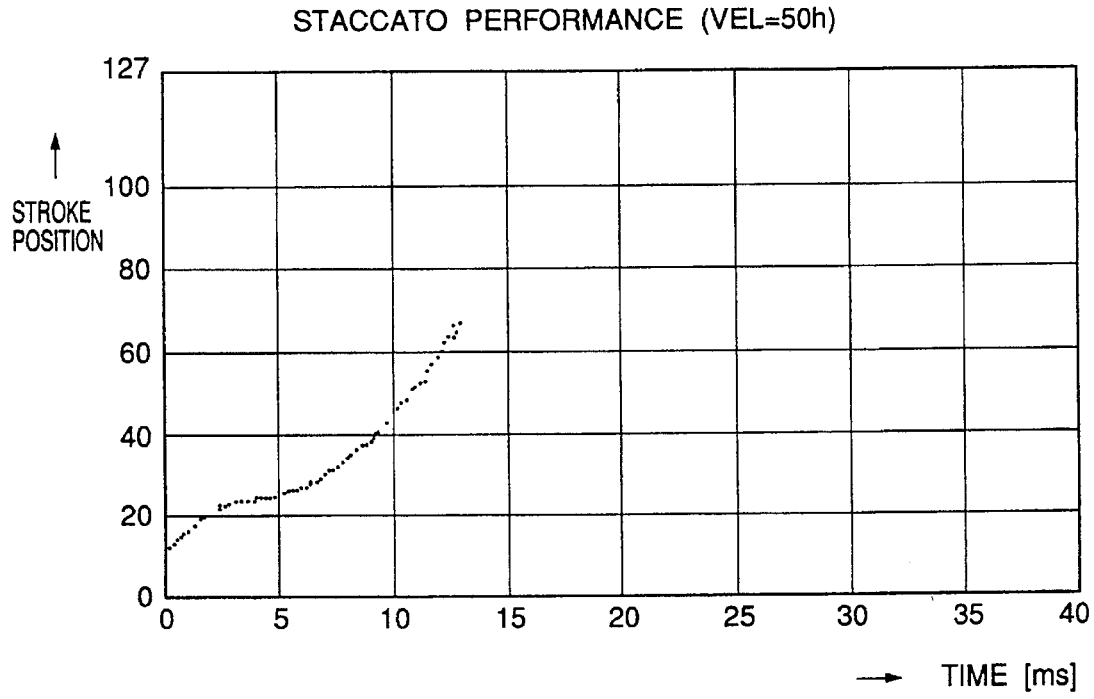
FIG. 9 is a graph showing another example of analysis of a key operating style based on detection of varying stroke positions, and more particularly showing measurements of the varying stroke positions in a staccato performance when velocity data VEL=50 (hexadecimal)

FIG. 9 is a graphic representation showing a stroke position variation occurring in a staccato performance when the velocity data VEL is of large value. Similarly to FIG. 8, FIG. 9 shows a stroke position variation with time in a staccato performance where the velocity data VEL has a value of 50 (hexadecimal). In a staccato performance, there is a great positional change in the course of a key depression, and a complicated variation is presented. In the illustrated example, an upwardly convex variation curve is found in the region of 0–5 ms, and a downwardly convex variation curve is found after 5 ms has passed. It may be surmised from the variation that no stable force acts on the key in the region where the upwardly convex variation is found. It is also possible that some reactive force works upon initiation of the key motion.

The following may be considered as the main reasons why the stroke positions in the staccato performance present a complicated, nonlinear variation as compared with the tenuto performance. The first cause may be components affected by the player's finger being dented upon contact with a key and then recovering to the undented state. Other causes may arise during key depression due to slight distortion of the key, action of the energy accumulating section of rubber, felt and other materials provided in the fulcrum of the key, and action of a shock absorbing section provided between respective drive points of each key and a corresponding hammer.

As seen from analysis of the varying stroke positions shown in the graphs, the staccato performance is characterized in that it provides an acuter variation curve than the tenuto performance. Consequently, by extracting such characteristics, it is possible to analytically identify differences between various key operating styles such as staccato and tenuto.

What are meant by the measured data in FIGS. 6 to 9 are that timewise variation in the stroke positions (i.e., timewise stroke position variation during the course of key depression) correlates to a key operating style. Thus, on the basis of timewise variation in the detected stroke positions, a key operating style can be determined or analyzed. Timewise variation in the stroke positions also correlates to a key depression velocity. So, by calculating instantaneous velocity values (each of which will be referred to as a current velocity to distinguish from the above-mentioned representative velocity VEL) from the measured data of FIGS. 6 to 9, it is found that timewise variation characteristics or pattern of the current velocities correlate to a key operating style. In another words, the time-variation characteristics or pattern of the current velocities, similarly to the timewise variation in the stroke positions, present various nonlinear distortions depending on a different key operating style. Generally, similarly to the timewise variation in the stroke positions, the time-variation characteristics or pattern of the current velocities present more nonlinear characteristics as the characteristics of a staccato performance become more intense. Consequently, it is allowed to determine or analyze a key operating style by calculating timewise variation in the current velocities or pattern on the basis of the timewise variation in the detected stroke positions.

Figure 12:
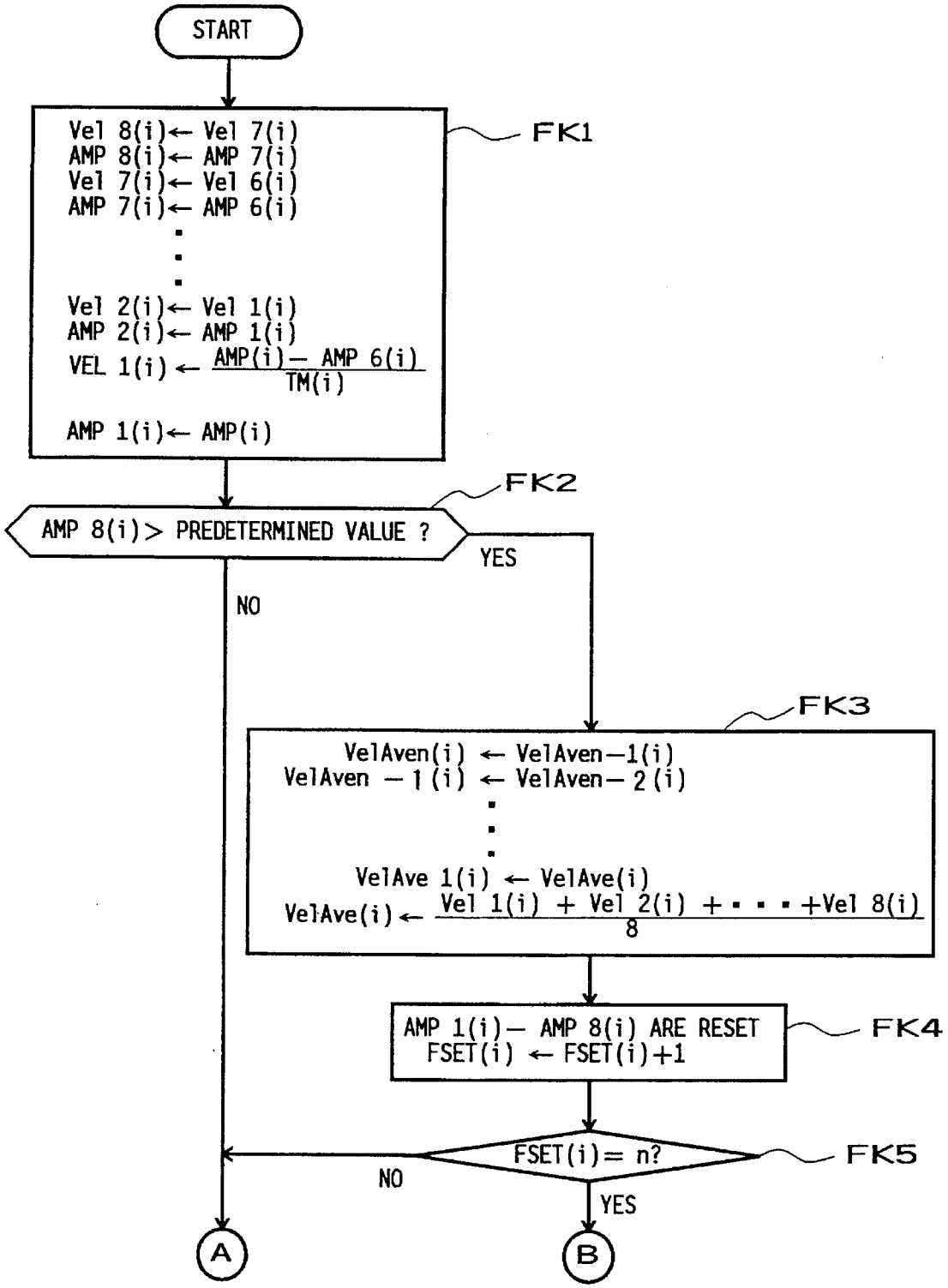
FIG. 12 is a flowchart showing a first part of a performance style analyzation calculation process executed in step FM4 of the main routine of FIG. 11.
Figure 13:
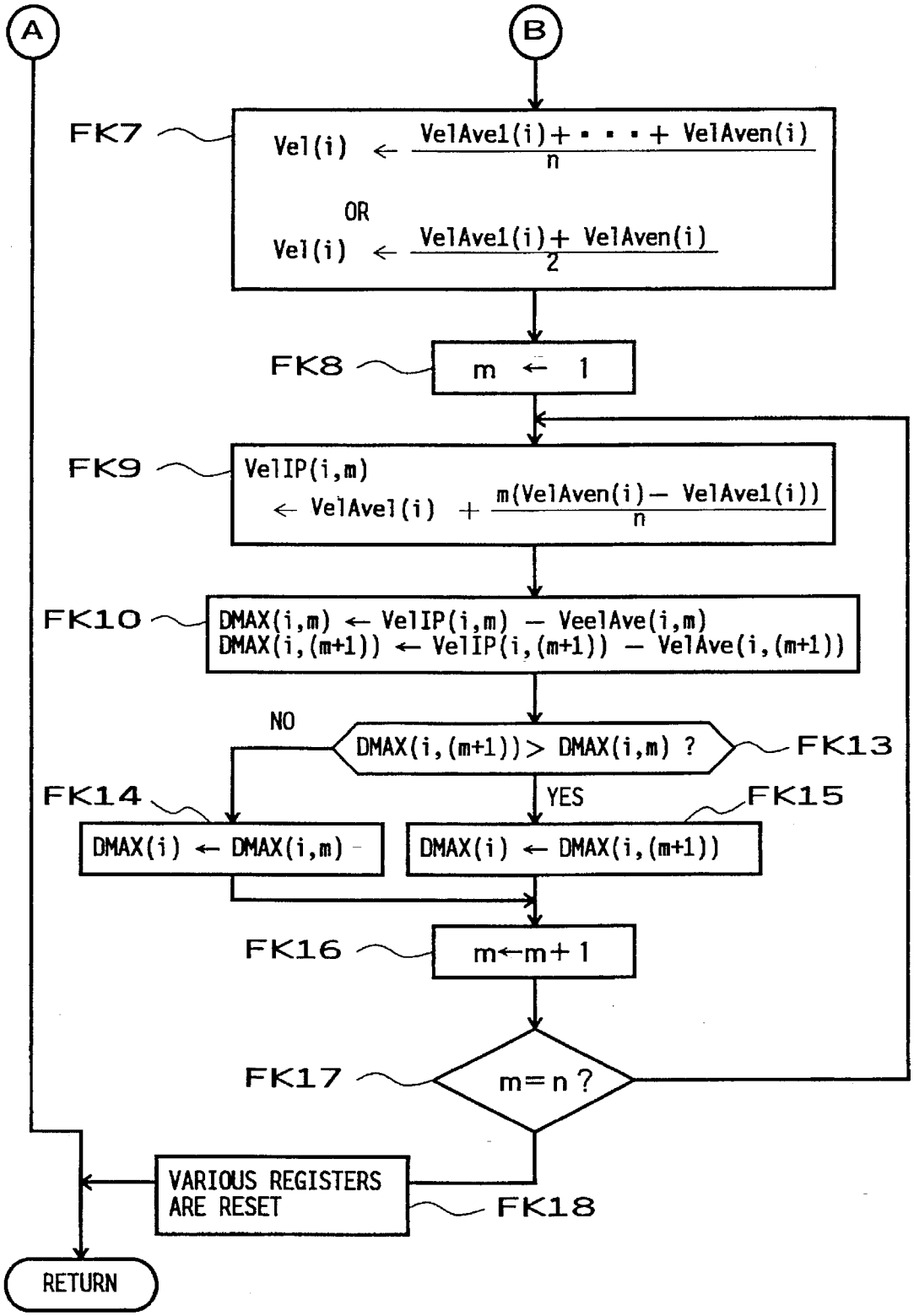
FIG. 13 is a flowchart showing a second part of the performance style analyzation calculation process.
Figure 15:
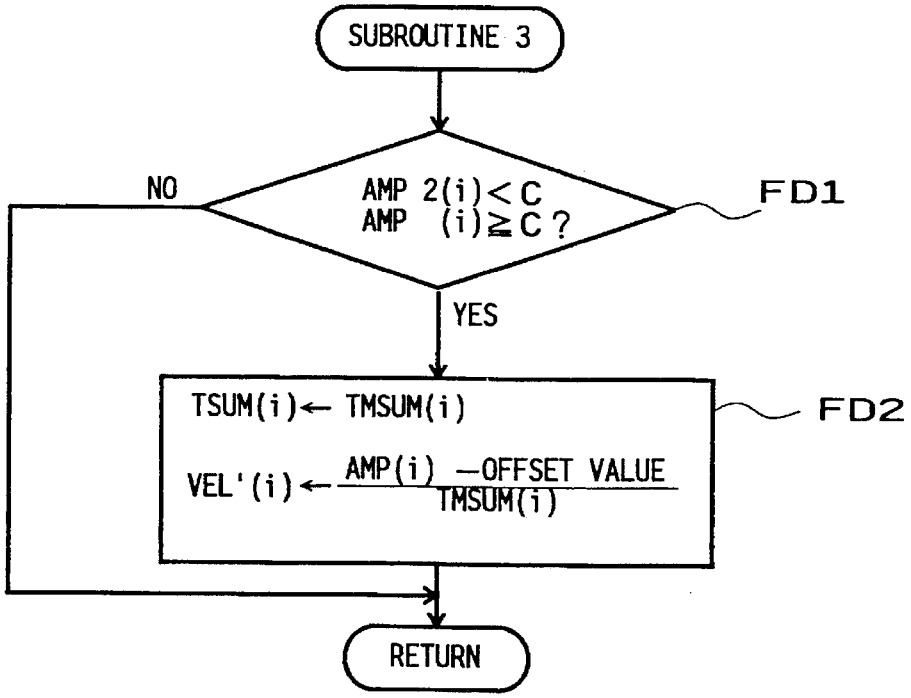
FIG. 15 is a flowchart illustrating an example sequence for calculating a key operating style and velocity data.
Figure 16:
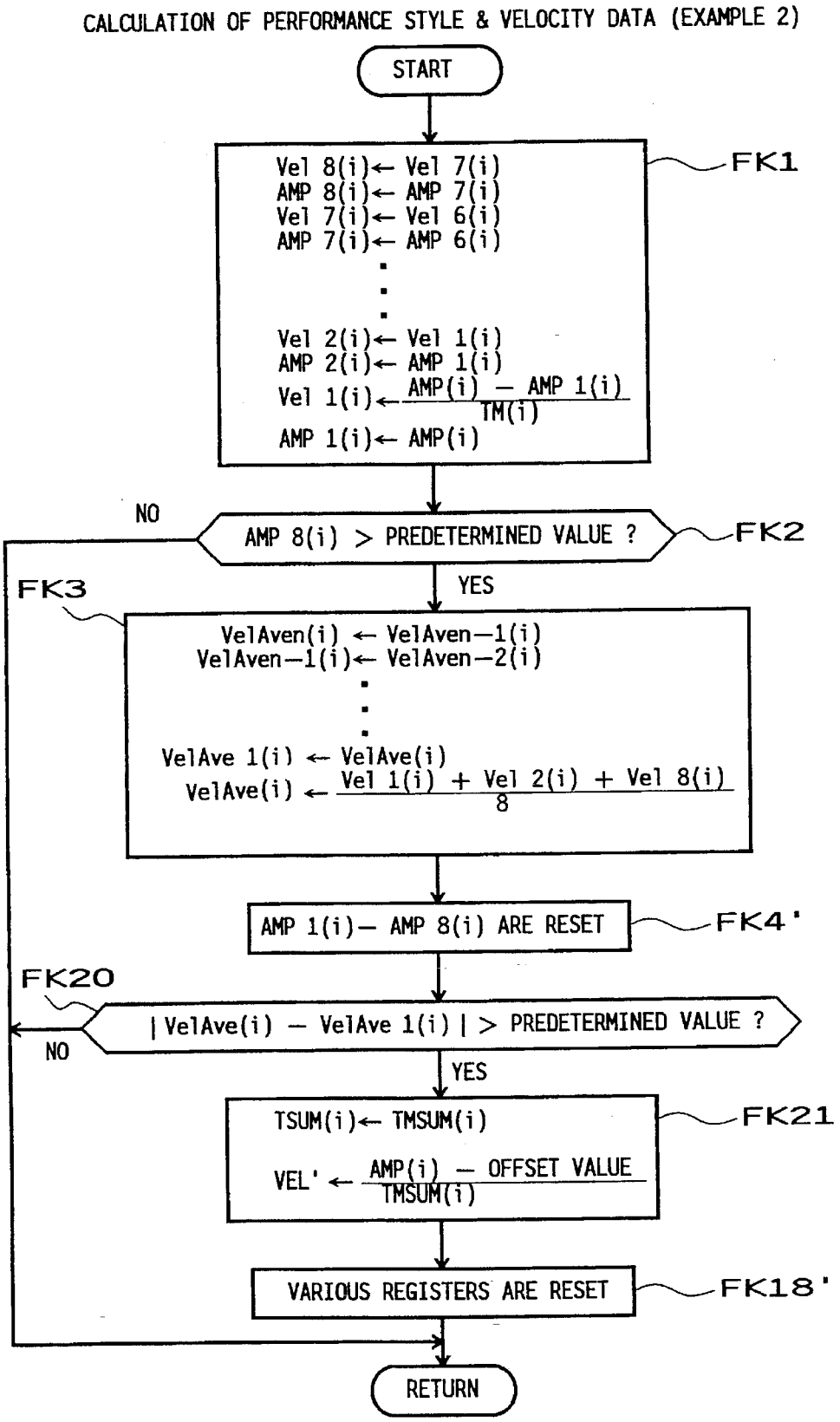
FIG. 16 is a flowchart illustrating another example sequence for calculating a key operating style and velocity data.

Now, with reference to FIGS. 10 to 18, explanation will be made on several detailed examples of sequences for determining or analyzing key operating styles. The example sequence shown in FIGS. 12 and 13 is principally directed to calculating timewise variation characteristics or pattern of the current velocities and determining or analyzing a key operating style on the basis of the calculated result. The example sequence shown in FIG. 15 is principally directed to quickly determining or analyzing a key operating style in a simplified style on the basis of timewise variation of detected stroke positions. Further, the example sequence shown in FIG. 16 is principally directed to determining or analyzing a key operating style at a relatively early stage after the initiation of a key depression, by detecting a sudden variation in the current velocities without calculating the overall timewise variation in the current velocities.

Figure 10:
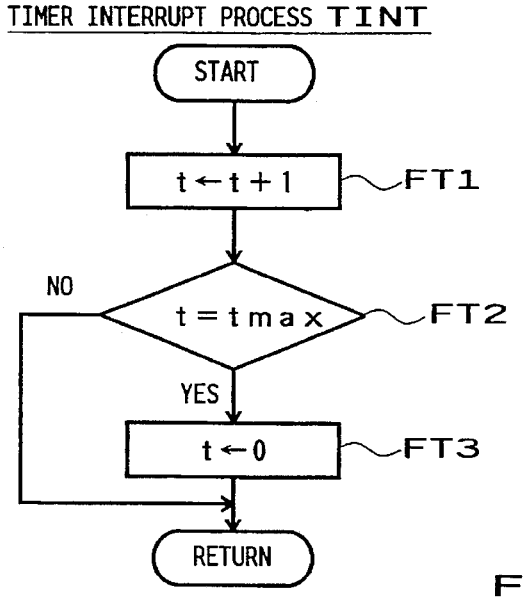
FIG. 10 is a flowchart of a timer interrupt process.

FIG. 10 is a flowchart of a timer interrupt process, which is carried out by the CPU 5 in response to each interrupt signal TINT generated at a predetermined time interval of about 1 to 10 μs.

First of all, in step FT1, a time counter t is incremented. The time counter t is a time counting register whose value is incremented each time the interrupt signal TINT is generated.

In next step FT2, it is determined whether the time counter t has reached a predetermined value Tmax. The predetermined value Tmax indicates a maximum value counted by the time counter T, and no time counting is made beyond this value Tmax. In this embodiment, the predetermined value Tmax is set at one million, for example.

If the time counter t has reached the predetermined value Tmax as determined in step FT2, the program goes to step FT3 in order to reset the time counter t to zero so that the time counter starts counting from zero next time. After step FT3, the program resumes a process interrupted by the interrupt process. If the time counter t has not reached the predetermined value Tmax, then the program bypasses step FT3 and resumes the process interrupted by the interrupt process.

Figure 11:
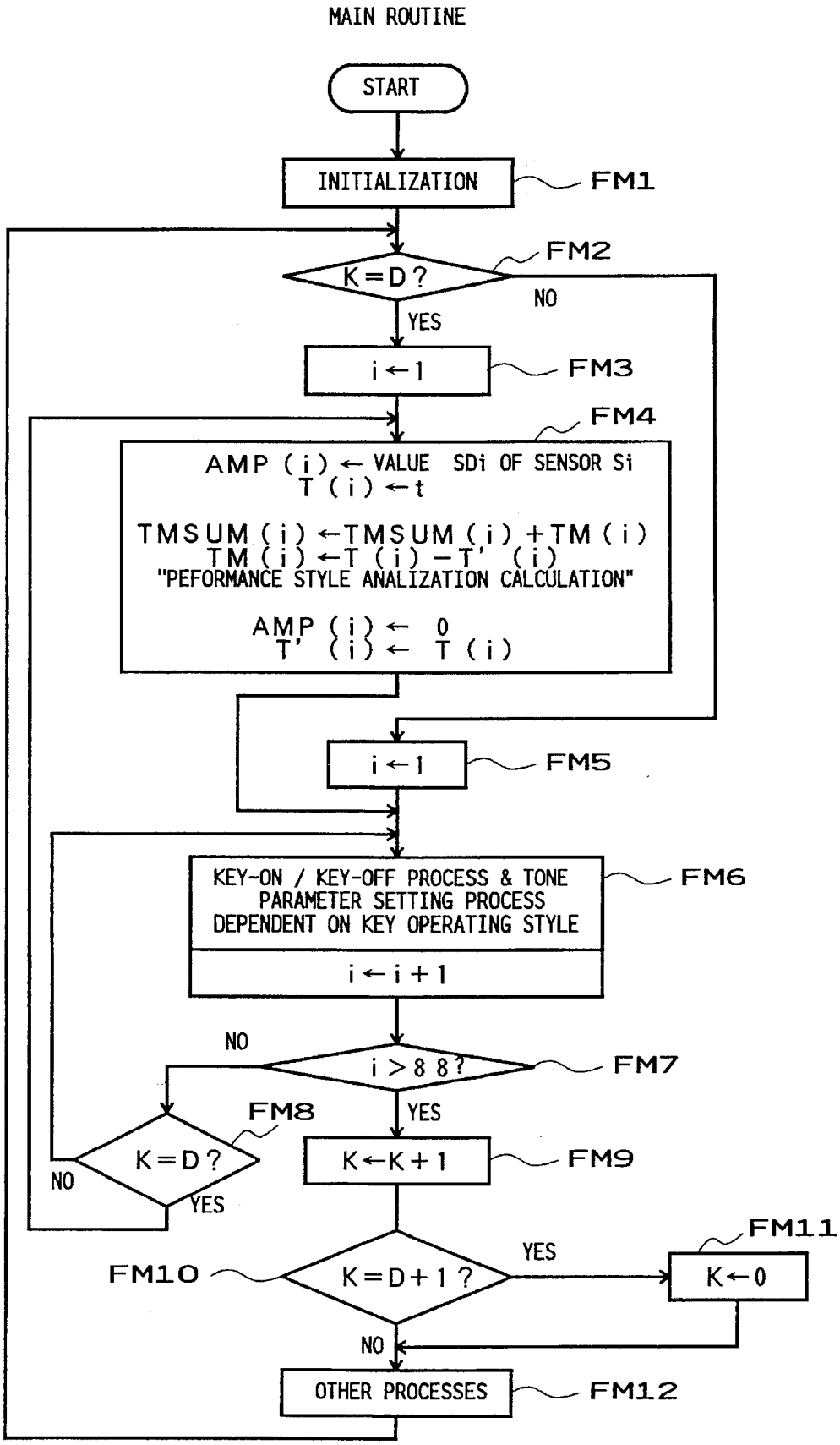
FIG. 11 is a flowchart of a main routine performed by a CPU shown in FIG. 1.

FIG. 11 is a flowchart of a main routine carried out by the CPU 5. It is assumed that the CPU 5 takes about 0.1 μs to execute one step of a specific command. First, in step FM1, various registers etc. are initialized, and a register for storing a given count value is set to "0".

In step FM2, it is checked whether the register K is at a predetermined value D which may for example be about three. Unless the register K is not at the predetermined value D, the program bypasses the following operations and proceeds to step FM5 to store "1" into the register K. Then, the program goes to step FM6. If, on the other hand, the register K is at the predetermined value D, the program goes to step FM3. Namely, the operations of step FM3 and FM4 are executed each time the register K reaches the count D.

In step FM3, "1" is set to a register i which is provided for storing the number of any of the 88 keys on the keyboard for which process is to be made. Then, the program FM4 proceeds to step FM4.

In step FM4, a detection is made of the stroke position of the key. Namely, the register K is checked in step FM2 so that the stroke position is detected at a frequency corresponding to the predetermined value D. The interval between the stroke positions is preferably about 1 ms.

First, a detection is made of the stroke sensor Si corresponding to the "i" the key, and the detected stroke position SDi converted into digital signal is stored into register AMP(i). Then, the count value of the time counter t is stored into register TM(i) which is originally set at "0" by the initialization operation of step FM1, and the value of register TMSUM(i) is incremented by the value stored in the register TM(i).

After that, into the register TM(i) is stored a value obtained by subtracting the value of register T'(i) from the value of the register T(i). The register T'(i) indicates the time when the last stroke position detection was performed, and the register TM(i) stores a time interval at which the stroke position detection is made.

Next, key operating style data DMAX(i) indicative of a kind of key operating style is obtained by performing a key operating style analyzing calculation as will be described later. After that, the stroke position register AMP(i) is cleared to "0", and the value of the register T(i) indicative of the current time is stored into the register T'(i). Then, the program goes to step FM6.

In step FM6, a key-on or key-off signal is sent to the tone source circuit, and tone parameters corresponding to the calculated key operating style data DMAX(i) are set and sent to the tone source circuit. The details of such operations will be described later. Subsequently, the program proceeds to step FM7 after the register i is incremented.

In step FM7, it is determined whether the value of the register i is greater than 88. A negative answer in step FM7 means that necessary operations for all the 88 keys on the keyboard have not yet been completed, and hence the program branches to step FM8 to further determine whether the register K is at the predetermined value D. With a determination of YES in step FM8, the program reverts to step FM4 to repeat the above-mentioned stroke position detection for the next key. If the register K is not at the predetermined value D as determined in step FM8, the program reverts to step FM8 to repeat such operations as sending a key-on or key-off signal for the next key.

If the value of the register i is greater than 88 as determined in step FM7, this means that necessary operations for all the 88 keys on the keyboard have been completed, and hence the program proceeds to step FM9 to increment the register K by one.

In next step FM10, a determination is made as to whether the register K is at a value of the predetermined value D plus 1 (K=D+1). With an affirmative answer in step FM10, the program branches to step FM11 to clear the register K to "0"

and then proceeds to step FM12. If the register K is not at a value of the predetermined value D plus 1, the program goes to step FM12 bypassing step FM11. Namely, the register K starts counting each time the predetermined value D plus 1 is reached.

In step FM12, parameters corresponding to the key switch operation are set for controlling tone color, effect etc. Further, other processes necessary for performance are performed, and then the program reverts step FM2 to repeat the above-mentioned operations.

FIGS. 12 and 13 is a flowchart of the key operating style analyzing calculation included in step FM4 of the main routine shown in FIG. 11.

In step FK1, the registers AMP1(i) to AMP8(i) store the history of respective stroke positions; the registers of larger register numbers indicate older stroke positions, and hence the register AMP8(i), for instance, indicates the oldest stroke position.

Registers Vel1(i) to Vel8(i) are used for storing the history of respective stroke-position variation velocities; the registers of larger register numbers indicate older stroke-position variation speeds, and hence the register Vel8(i), for instance, indicates the oldest stroke-position variation speed.

Each of the two sets of the eight registers Vel1(i) to Vel8(i) and the eight registers AMP1(i) to AMP8(i) functions as a shift register. By the initialization operation, all these registers are cleared to "0". For example, the value of the register Vel7(i) is shifted to the register Vel8(i), and likewise the value of the register AMP7(i) is shifted to the register AMP8(i). By performing such shift register processing for seven pairs of the adjacent registers in each of the register sets, the value stored in each register set is shifted in a direction from Vel1(i) to Vel8(i) or from AMP1(i) to AMP8(i). Consequently, the following values are stored into the individual registers.

Expression 1

Vel8(i)←Vel7(i)
AMP8(i)←AMP7(i)
Vel7(i)←Vel6(i)
AMP7(i)←AMP6(i)
Vel6(i)←Vel5(i)
AMP6(i)←AMP5(i)
Vel5(i)←Vel4(i)
AMP5(i)←AMP4(i)
Vel4(i)←Vel3(i)
AMP4(i)←AMP3(i)
Vel3(i)←Vel2(i)
AMP3(i)←AMP2(i)
Vel2(i)←Vel1(i)
AMP2(i)←AMP1(i)

Then, into the register Vel1(i) is stored velocity data that is indicative of a variation between the latest-detected stroke position and the preceding stroke position, as shown in the following expression:

Expression 2

Vel1(i)←{AMP(i)−AMP1(i)}/TM(i)

Here, the register AMP(i) indicates the latest stroke position, and the register AMP1(i) indicates the stroke position preceding the latest stroke position. The register TM(i) indicates a time interval at which the stroke position detection is performed. It should be noted that the velocity Vel calculated by the expression 2 above is the current velocity and is different from the velocity VEL in the horizontal axis of FIG. 2.

After that, the value of the AMP(i) indicating the current stroke position is stored into the register AMP1(i).

In step FK2, a determination is made as to whether the value of the register AMP8(i) is Greater than a predetermined value. The predetermined value is indicative of a predetermined noise level, and hence if a value Greater than the predetermined noise level is stored in the register AMP8(i), this means that the value has been shifted sequentially from the register AMP1(i).

If the stored value of the register AMP8(i) is not greater than the predetermined value, this means that the stroke position data has not yet been stored in all of the eight registers AMP1(i) to AMP8(i), and thus the program returns to the main routine of FIG. 11 via a connector A. If, on the other hand, the stored value of the register AMP8(i) is greater than the predetermined value, this means that eight stroke position data have been stored in all of the eight registers AMP1(i) to AMP8(i), and thus the program proceeds to step FK3.

In step FK3, registers VelAve1(i) to VelAven(i) are used for storing respective average velocity values of the stroke velocities indicated by the registers Vel1(i) to Vel8(i).

A predetermined number n of the registers VelAve1(i) to VelAven(i) function as a shift register, and all the individual registers VelAve1(i) to VelAven(i) are cleared to "0" by the initialization process. The following operations are performed to execute shift register processing for n pairs of the registers.

Expression 3

VelAven(i)←VelAven-1(i)
VelAven-1(i)←VelAven-2(i)
VelAven1(i)←VelAve(i)

After that, the following calculation is executed to obtain the average velocity value of the eight velocities indicated by the registers Vel1(i) to Vel8(i).

Expression 4

VelAve(i)←{Vel1(i)+Vel2(i)+Vel3(i)+Vel4(i)+Vel5(i)+Vel6(i)+Vel7(i)+Vel8(i)}/8

In step FK4, the eight registers AMP1(i) to AMP8(i) are all reset to "0", and register FSET(i) is incremented by one. The register FSET(i) is used for indicating that the stroke position detection is being performed, so that the stroke position detection is terminated once the register FSET(i) has reached a predetermined value n.

In next step FK5, a determination is made as to whether the register FSET(i) is at the predetermined value n. A negative determination in step FK5 means that the average velocity value has not been input to all the registers VelAve1(i) to VelAven(i), and thus the program returns to the main routine of FIG. 11 via the connector A. If, on the other hand, the register FSET(i) is at the predetermined value n, this means that the respective average velocity values have been input to all the registers VelAve1(i) to VelAven(i), and thus the program proceeds to a connector B.

FIG. 13 is a flowchart of the calculation flow continued from the connectors A and B of FIG. 2. Via the connector A, the program returns to the main routine of FIG. 11.

Via the connector B, the program proceeds to step FK7 to obtain a macro average velocity Vel(i) on the basis of the following expression:

Expression 5

Vel(i)←{VelAve1(i)+ . . . +VelAven(i)}/n

The thus-obtained macro average velocity Vel(i) is the average of n micro average velocity values VelAve1(i) to VelAven(i). Alternatively, the average of the first and last micro average velocity value VelAve1(i) and VelAven(i) may be obtained using the following expression:

Expression 6

Vel(i)←{VelAve1(i)+VelAven(i)}/2

In step FK8, an interpolation counter m which counts from "1" to "n" is set to "1". After step FK8, the program goes to step FK9.

In step FK9, an interpolated average velocity VelIP(i, m) is obtained on the basis of the following expression 7. The interpolated average velocity VelIP(i, m) represents an average velocity for interpolation position m between 1 and n, i.e., represents an average velocity obtained by linear interpolation.

Expression 7

VelIP(i, m)←VelAve1(i)+m {VelAven(i)−VelAve1(i)}/n

In next step FK10, a differential velocity DMAX(i, m) at interpolation position m and a differential velocity DMAX(i, m+1) at interpolation position m+1 are respectively obtained by the following expression. Namely, the differential velocity DMAX represents a difference between the interpolated value (average velocity VelIP(i, m)) at the same m-the interpolation position that is obtained by linear interpolation and the measured value ("m" the micro average velocity VelAve(i, m)).

Expression 8

DMAX(i, m)←VelIP(i, m)−VelAve(i, m)

DMAX(i, m+1)←VelIP(i, m+1)−VelAve(i, m+1)

Therefore, as the micro average velocities vary more linearly, the value of the differential velocity DMAX(i, m) becomes smaller.

In next step FK13, a determination is made as to whether the differential velocity DMAX(i, m+1) is greater than the differential velocity DMAX(i, m). With an affirmative determination, the program proceeds to step FK15 in order to store the differential velocity DMAX(i, m+1) into a maximum differential velocity value register DMAX(i). If the differential velocity DMAX(i, m+1) is not greater than the differential velocity DMAX(i, m), the program branches to step FK14 in order to store the differential velocity DMAX(i, m) into the maximum differential velocity value register DMAX(i). In this way, the maximum differential velocity is stored into the maximum differential velocity value register DMAX(i).

The interpolation counter m is incremented by one in step FK16, and then the program proceeds to step FK17 to examine whether the interpolation counter m is at the value n. If answered in the negative in step FK17, the program goes back to step FK9 in order to repeat the above-mentioned operations for the interpolation counter m. If, however, the interpolation counter m is at the value n, this signifies the end of the process, and hence the program moves to step FK18.

In step FK18, various registers such as registers FSET(i), m, VelIP(i, m), VelIP(i, m+1), DMAX(i, m) and DMAX(i, m+1) are reset. After that, the program returns to the main routine of FIG. 11.

The maximum differential value DMAX(i) indicates the kind of a key operating style. The larger the maximum differential value DMAX(i), the larger curve is found in the graph illustrating the stroke position variation, and so the larger maximum differential value DMAX(i) indicates a staccato or staccato-like performance. Conversely, the smaller the maximum differential value DMAX(i), the smaller curve is found in the stroke position variation graph, and so the smaller maximum differential value DMAX(i) indicates a tenuto or tenuto-like performance.

In this embodiment, tone is controlled by reading out tone control coefficients from the tone control amount tables, using the maximum differential value DMAX(i) as the key operating style represented by the vertical axis of the tone control amount conversion table shown in FIG. 2. In this case, the velocity data VEL in the horizontal axis of FIG. 2 may comprise such data obtained by measuring time differences between the two contacts of the key switch corresponding to the depressed key among the key switches 1 as earlier mentioned, or may comprise macro average velocities Vel(i) obtained in the above-mentioned manner.

It should be noted that the key operating style can be determined not only by using the maximum differential value DMAX(i) as mentioned above, but also by, after step FK10, obtaining an integrated value DMAXSUM(i) of differential velocities by the use of the following expression:

Expression 9

DMAXSUM(i)←DMAXSUM(i)+DMAX(i, m)

The integrated value DMAXSUM(i) is an integrated value of the respective differential velocities of the individual interpolation positions m. Therefore, as in the case of the maximum differential value DMAX(i), larger difference-integrated values DMAXSUM(i) indicate a staccato or staccato-like key operating style, and smaller integrated values DMAXSUM(i) indicate a tenuto or tenuto-like key operating style. The key operating style can also be determined from the average value of the differential velocities which is obtained by dividing the difference-integrated values DMAXSUM(i) by the value n.

In addition to the above-mentioned approaches, the performance can also be determined by the use of data ACC(i) that represents a timewise variation of the maximum differential values DMAX(i). ACC(i, m) is calculated by the use of the following expression, after step FK10 of the calculation flow shown in FIG. 13:

Expression 10

ACC(i, m)←|DMAX(i, m)−DMAX(i,m+1)|

Performance data ACC(i) is obtained by calculating the maximum value of the thus-calculated ACC(i, m) data. The performance data can also be determined by calculating the integrated value or the average of the integrated values, in stead of the maximum value. Since the data ACC(i) represents a timewise variation of the maximum differential values DMAX(i), larger ACC(i) values will result in a larger curve in the graph illustrating the stroke position variation and consequently indicate a staccato or staccato-like key operating style. Conversely, smaller ACC(i) values indicate a tenuto or tenuto-like key operating style.

Now, with reference to the graphs of FIGS. 6 to 9 showing the stroke position variations with the lapse of time, a description will be made on the result of the above-mentioned key operating style analyzing calculation.

First, in FIG. 6, when the process has been performed n=15 (decimal number) times, the difference-integrated value DMAXSUM(i) is 1400h, and the average value of the difference-integrated values DMAXSUM(i) is 155h. In FIG. 7, when the process has been performed n=12 (decimal number) times, the difference-integrated value DMAXSUM(i) is 1218h, and the average value of the difference-integrated values DMAXSUM(i) is 182h. Accordingly, where the velocity data VEL is 38h, the average value of the difference-integrated values DMAXSUM(i) makes it possible to confirm that the average value of the differential velocities is greater in the staccato performance than in the tenuto performance.

Further, in FIG. 8, when the process has been performed n=7 (decimal number) times, the difference-integrated value DMAXSUM(i) is 600h, and the average value of the difference-integrated values DMAXSUM(i) is dbh. In FIG. 9, when the process has been performed n=5 (decimal number) times, the average value of the difference-integrated values DMAXSUM(i) is 3b3h. Accordingly, where the velocity data VEL is 50h, the average value of the difference-integrated values DMAXSUM(i) makes it possible to confirm that the average value of the differential velocities is greater in the staccato performance than in the tenuto performance.

As mentioned above, even when the velocity data VEL is the same, the key operating style can be determined by obtaining the average value of the difference-integrated values DMAXSUM(i); that is, the larger average value of the difference-integrated values DMAXSUM(i) signifies a staccato or staccato-like performance, and the smaller average value of the difference-integrated values DMAXSUM(i) signifies a tenuto or tenuto-like performance.

Figure 14:
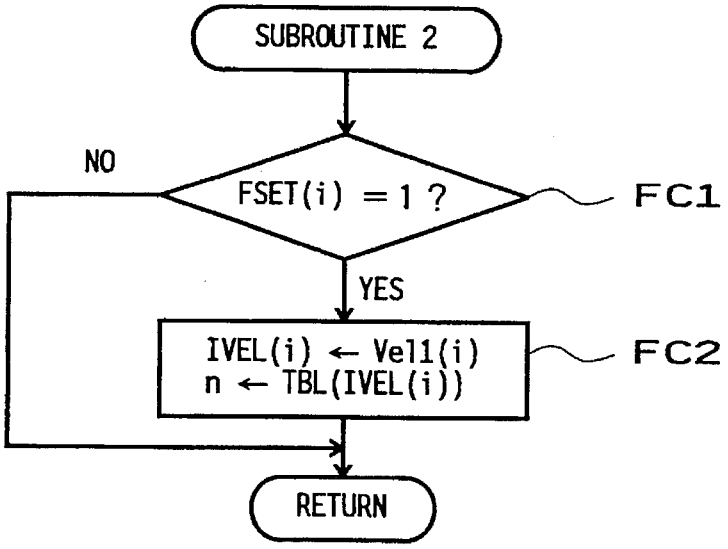
FIG. 14 is a flowchart of a subroutine for setting the number-of-times n of processing for use in the process of FIG. 12.

FIG. 14 is a flowchart of subroutine 2 which illustrates the process, used in the calculation of FIGS. 12 and 13, for setting the number of times n the process is performed (number-of-times n of the process). Although the number-times n of the process has been described as a predetermined value in the above-mentioned calculation, it is also possible to variably set the number of times n to any suitable value by carrying out the following operations after step FK4 of FIG. 12.

First, in step FC1, it is examined whether the register FSET(i) is at "1" or not. An affirmative determination in this step means that it is the first process, the program proceeds to step FC2 to set the number of times n. If, however, the register FSET(i) is greater than "1", it is not necessary to set the number of times n, and hence the program directly reverts to the calculation flow of FIG. 13.

In step FC2, the value of register Vell(i) showing velocity data is stored into register IVEL(i). Then, a table value TBL(IVEL(i)) is read out on the basis of the value of the register IVEL(i) and stored into the register n to set the number of times. After this operation, the program reverts to the calculation flow of FIG. 13.

As mentioned above, the number of times n the process is to be performed is determined depending on the velocity data Vell(i). In general, the higher the key depression velocity, the shorter becomes a period before tone is generated by the key depression. Conversely, the lower the key depression velocity, the longer becomes a period before tone is generated by the key depression. Consequently, where the key velocity is high, it will not be possible to be in time for tone generation timing unless the number of times n is reduced. Conversely, where the key velocity is low, it will be possible to be in time for tone generation timing even if the number of times n is increased.

Although the embodiment has been described above as using only the initial velocity Vell(i) in the register IVEL(i), any one of plural velocity data values may alternatively be used, such as by storing the average value of initial three velocity values Vel1(i) to Vel3(i) in the register IVEL(i).

FIG. 15 is a flowchart of subroutine 3 which illustrates an example sequence for calculating a key operating style and velocity data (Example 1). In this embodiment, velocity data VEL'(i) and key operating style TSUM(i) are calculated.

It is assumed here that the following operations are performed after step FK1 of FIG. 12 and steps FK5 to FK18 are omitted, and that the above-mentioned setting of the number of times n in FIG. 14 is also omitted.

If, in step FD1, the stroke position AMP2(i) is smaller than a predetermined value C and the stroke position AMP(i) is equal to or greater than the predetermined value C, this means that a key has been depressed further than a predetermined stroke position, and thus the program proceeds to step FD2 so as to obtain input value TSUM(i) and VEL'(i) of the conversion table. If the conditions are not satisfied in step FD1, the subroutine reverts to the calculation flow of FIG. 12.

In step FD2, time TMSUM(i) lapsed since the initiation of the key depression is stored into the register TSUM(i). After that, the subroutine reverts to the start point of FIG. 12 after the latest stroke position AMP(i) and velocity data VEL'(i) are calculated by the following expression:

Expression 11

VEL'={AMP(i)−Offset Value}/TMSUM(i)

TSUM(i) represents a time from the time point when the key depression is initiated to the time point when a predetermined stroke position is reached. On the basis of this time is determined a key operating style. A tone control amount is determined from the tone control amount conversion table of FIG. 2, by replacing the data in the horizontal and vertical axes with velocity data VEL'(i) and key operating style data TSUM(i), respectively.

FIG. 16 is a flowchart of a performance-style analyzing calculation which illustrates still another example sequence for calculating a key operating style and velocity data (Example 2). Here, velocity data VEL'(i) and key operating style TSUM(i) are calculated in a different manner from the subroutine of FIG. 15. Namely, the following performance-style extraction operations are performed in place of the calculation operations of FIG. 12.

In step FK1, similarly to the above-mentioned operation of step FK1 of FIG. 12, shift register processing is performed for each of the eight velocity registers Vel1(i) to Vel8(i) and stroke position registers AMP1(i) to AMP8(i), so as to obtain the velocity data Vel(i) and stroke position AMP1(i) of the Expression 2.

In step FK2, it is check whether the value of the stroke position register AMP8(i) is greater than a predetermined value, in order to determine whether the value is above the noise level. If the value is greater than the predetermined value, the program proceeds to step step FK3, but if not, the program returns to the main routine of FIG. 11.

In step FK3, similarly to the above-mentioned operation of FIG. 12, shift register processing is performed for n registers VelAve1(i) to VelAven(i) indicating the average velocity, in order to obtain the micro average velocity VelAve(i) of the Expression 4. Next, in step FK4', the eight registers AMP1(i) to AMP8(i) are reset.

In step FK20, a determination is made as to whether the absolute value of a difference between the currently-obtained micro average velocity VelAve(i) and the last-obtained micro average velocity VelAve1(i) is greater than a predetermined value. An affirmative determination in step FK20 means that a predetermined displacement has been detected, and hence the program proceeds to step FK21. With a negative determination, however, the program returns to the main routine of FIG. 11.

In step FK21, time TMSUM(i) lapsed since the initiation of the key depression is stored into the register TSUM(i). After that, velocity data VEL'(i) of the latest stroke position AMP(i) is calculated by the following expression:

Expression 12

VEL'={AMP(i)−Offset Value}/TMSUM(i)

Various registers are rest in step FK18', and then the program returns to the main routine of FIG. 11.

Although the examination in step FK20 is made by the use of two micro average velocities VelAvel(i) and VelAve(i), a finer form of each specific key operating style can be determined if the examination is made using three or more micro average velocities.

Figure 17:
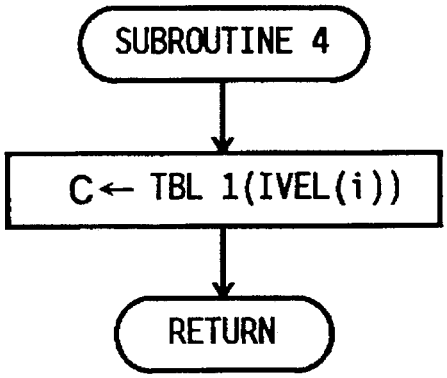
FIG. 17 is a flowchart of a subroutine for setting a threshold C for use in the process of FIG. 15.

Further, FIG. 17 is a flowchart of subroutine 4 which is directed to setting the predetermined value C used in the subroutine 3 of FIG. 15. In this subroutine 4, the subroutine 2 of FIG. 14 and the subroutine 3 of FIG. 15 are used in combination, and the following operations are performed after step FC2 of the subroutine 2 of FIG. 14.

In the subroutine 4, a table value TBL1(IVEL(i)) is read out using the value IVEL(i) obtained in step FC2 of the subroutine 2, to thereby set the threshold value C. After that, the program reverts to the subroutine 2, and the above-mentioned comparisons with the threshold value C are made in the subroutine 3 of FIG. 15.

Figure 18:
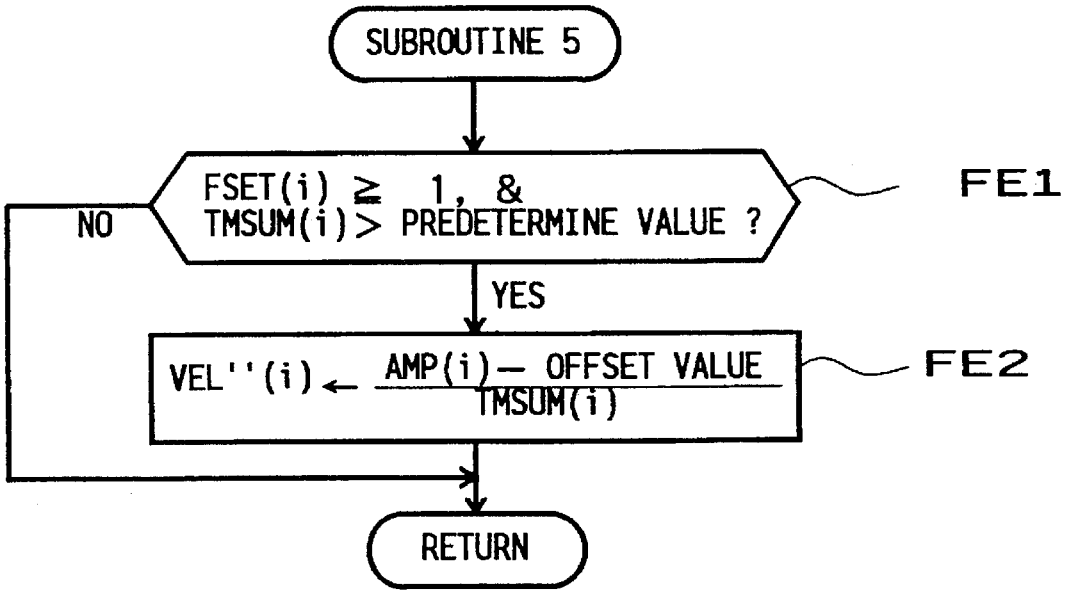
FIG. 18 is a flowchart illustrating still another example sequence for calculating velocity data.

FIG. 18 is a flowchart of subroutine 5 which illustrates an example sequence (Example 3) for calculating another velocity data VEL"(i) for use in the conversion table of FIG. 2. The following operations are performed after step FK1 of the calculation flow of FIG. 12. At this time, the subroutine 2 of FIG. 14 may be either performed or omitted as desired.

If, in step FE1 of the subroutine 5, the register FSET(i) is at a value equal to or greater than "1" and the value of the register TMSUM(i) is greater than a predetermined value, this means that a predetermined time has passed since the initiation of the key depression, and hence the program proceeds to step FE2. If a negative determination results in step FE1, however, the program directly reverts to the performance style analyzation calculation FIG. 12.

In step FE2, velocity data VEL"(i) after lapse of a predetermined time is calculated by the following expression. After that, the program reverts to the calculation flow of FIG. 12.

Expression 13

$$VEL''=\{AMP(i)-\text{Offset Value}\}/TMSUM(i)$$

The velocity data VEL" is an initial key depression velocity obtained by using a stroke position AMP(i) detected after a predetermined time has passed since the key depression. Tone control is performed in response to the initial velocity VEL"(i), using such velocity data VEL"(i) as the horizontal axis data of the conversion table of FIG. 2.

Characteristics of each key operating style appear in the initial portion immediately after the key depression, and thus it suffices to only extract the characteristic portion.

The velocity data represents a velocity value for a period from a time point when the first contact of the key is turned ON to a time point when the second contact of the key is turned ON, while the velocity data VEL' and VEL" each represent an initial velocity value during the key depression. Thus, for the tone control amount conversion table, control amounts may be obtained using more than two input values, such as velocity data VEL, initial velocity VEL' and performance style DMAXSUM.

Figure 19:
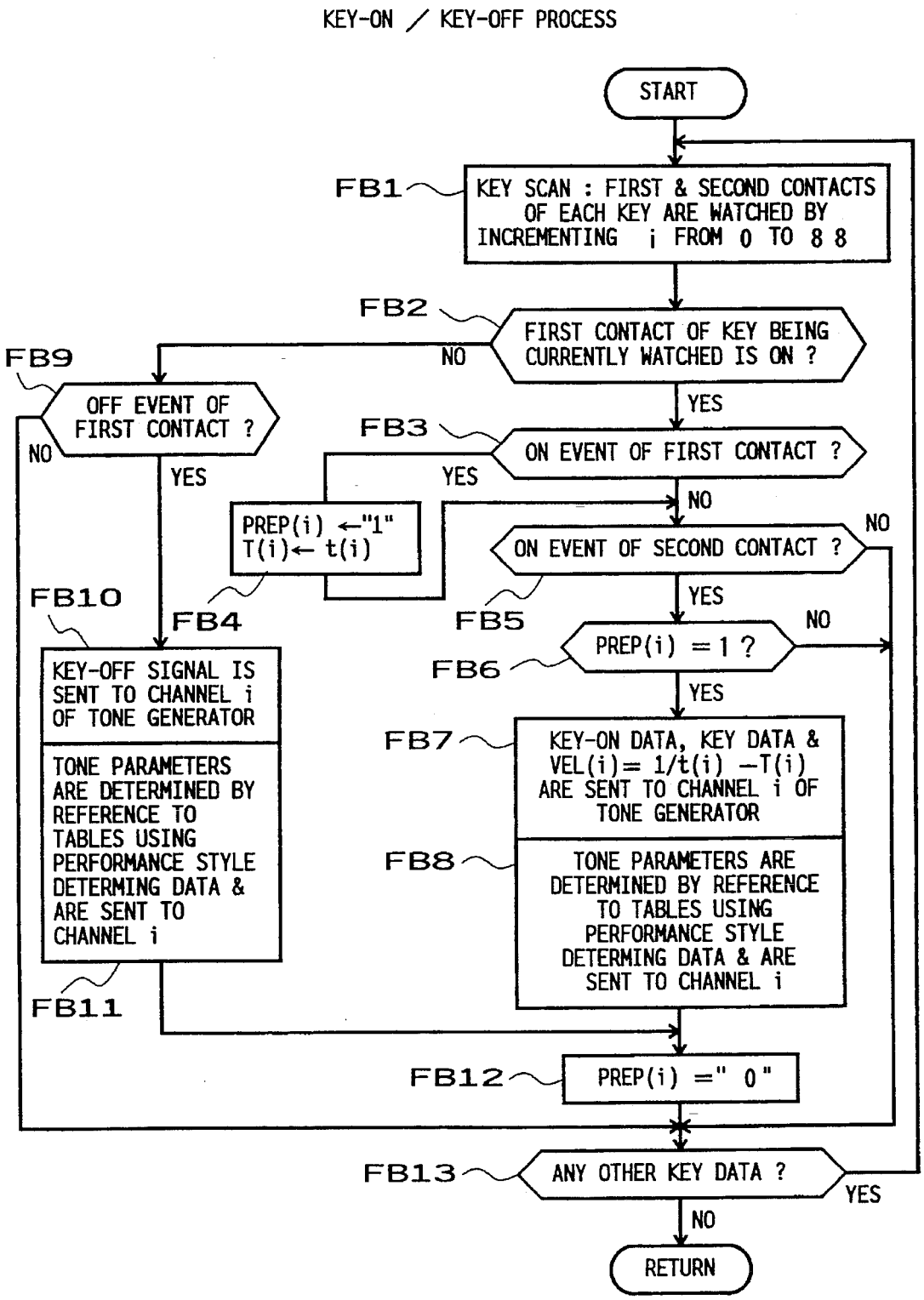
FIG. 19 is a flowchart illustrating an example sequence for sending a tone source circuit a key-on or key-off signal in the main routine of FIG. 11.

FIG. 19 is a flowchart of a key-on/key-off process which is directed to sending the tone source circuit a key-on or key-off signal noted in step FM6 of the main routine shown in FIG. 11.

In step FB1, variations in the respective states of the first and second contacts of all the keys are watched by sequentially changing the value of the counter i from "0" to "88".

In step FB2, it is examined whether the first contact of the key being currently watched is in the ON state or not. If answered in the affirmative, the program proceeds to step FB3, but if not, the program branches to step FM9.

In step FB3, it is determined whether there has been an ON event of the first contact being currently watched. An affirmative determination in step FB3 means that the first contact has been changed from the OFF state to the ON state, and thus the program goes to step FB4, where "1" is set into flag PREP(i), the current time t(i) counted by the timer interrupt process of FIG. 10 is stored into the register T(i) and other necessary operations are performed in readiness for generation of tone. After step FB4, the program proceeds to step FB5. If no ON event has occurred to the first contact as determined in step FB3, the program bypasses step FB4 to go to step FB5.

In step FB5, it is determined whether there has been an ON event of the second contact being currently watched. If answered in the negative, the program bypasses the following operations to go to step FB13, and if answered in the affirmative, the program goes to step FB6.

In step FB6, it is determined whether the flag PREP(i) is at "1" or not. If the flag PREP(i) is not at "1", this means that key-on or key-off data has already been sent to the tone source circuit, and hence the program bypasses the following operations to go to step FB13. If, on the other hand, the flag PREP(i) is at "1", the program proceeds to step FB7.

In step FB7, key-on data, key data (key code) and velocity data VEL(i) are sent to a channel i of the tone source circuit. The velocity data VEL represents a velocity value for a period from the time point when the first contact has been turned ON to the time point when the second contact has been turned ON.

The velocity dada VEL(i) is obtained by the following expression:

Expression 14

$$VEL=1/\{t(i)-T(i)\}$$

, where T(i) represents the time point when the first contact has been turned ON, and t(i) represent the time point when the second contact has been turned ON.

In next step FB8, parameters for controlling tone volume, tone colors and the like are determined by reference to such tone control tables as shown in FIG. 2, using the performance style determining data DMAX, DMAXSUM etc. These parameters are sent to the channel i of the tone source circuit. After that, the flag PREP(i) is reset to "0" in step FB12, and the program then goes to step FB13.

In step FB13, a determination is made as to whether there is any other key data. If answered in the affirmative in step FB13, the program reverts step FB1 to repeat the above-mentioned operations. If, however, no other key data is present, the program returns to the main routine of FIG. 11.

Step FB9 is executed when the first contact being watched is not in the ON state, in order to determine whether there has been an OFF event of the first contact. If there has been no OFF event of the first contact as determined in step FB9, the program goes to step FB13 bypassing the following operations. If, however, there has been an OFF event of the first contact as determined in step FB9, the program goes to step FB10.

In step FB10, a key-off signal is sent to the channel i of the tone source circuit. Next, in step FB11, tone parameters are determined by reference to such tone control tables as shown in FIG. 2, using the performance style determining data DMAX, DMAXSUM etc. These parameters are sent to the channel i of the tone source circuit. After that, the flag PREP(i) is reset to "0" in step FB12, and the program then goes to step FB13. The reason why the flag PREP(i) is reset to "0" may be that the first contact in the ON state is turned OFF without the second contact being turned ON.

In step FB13, a determination is made as to whether there is any other key data. If answered in the affirmative in step FB13, the program reverts step FB1 to repeat the above-mentioned operations. If, however, no other key data is present, the program returns to the main routine of FIG. 11.

Explanation has been made so far on examples where a degree of nonlinearity of key movement is determined on the basis of the exemplary case where the key stroke linearly varies with time, but the nonlinearity can also be determined by the use of any other standard, such as whether the variation curve is upwardly or downwardly convex, or the curvature of stroke variation with lapse of time. Alternatively, a plurality of such standards may be used in combination. Alternatively, such a keyboard may be employed in which variation in the key operating style appears in the stroke variation more clearly than in the prior art.

Figure 20:
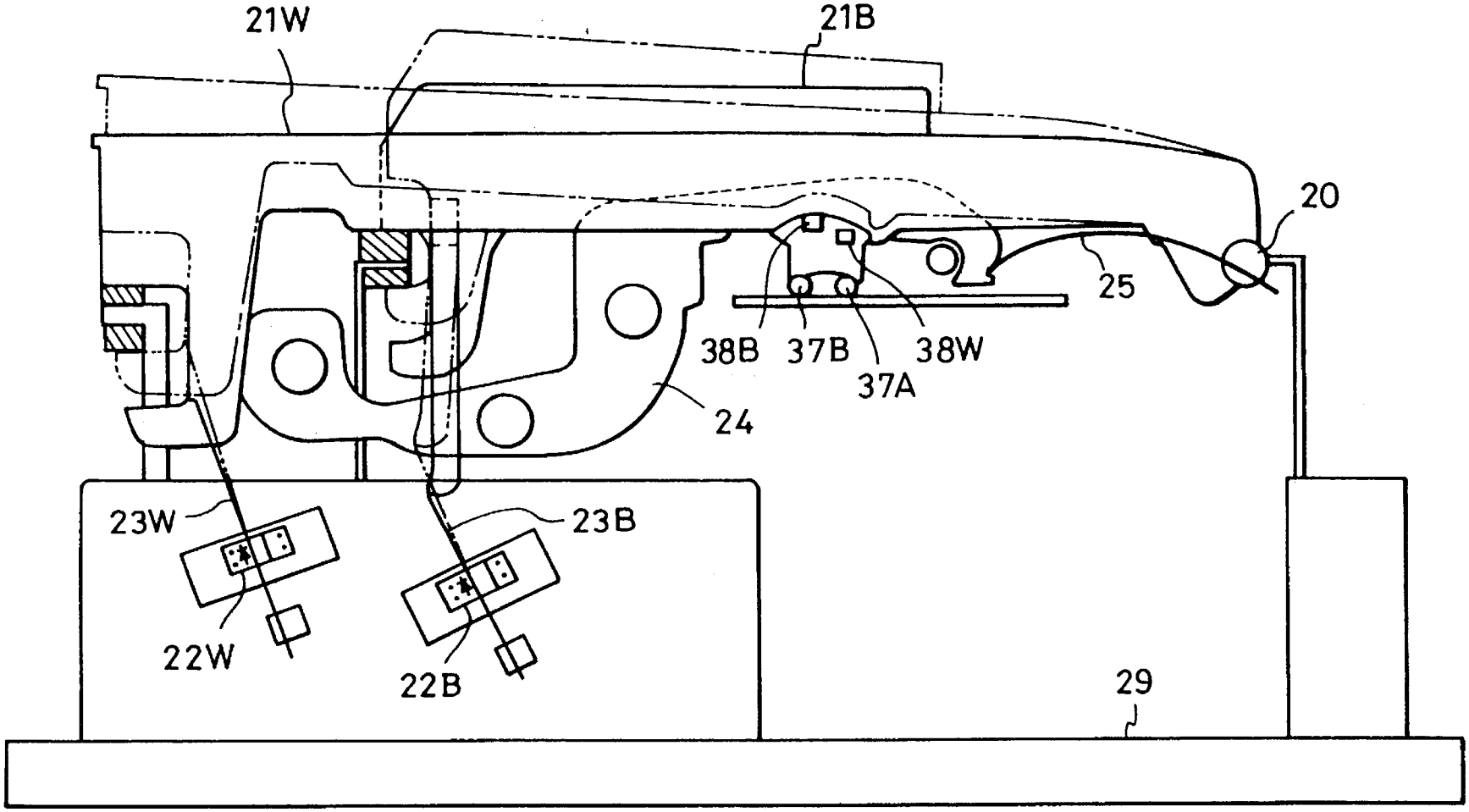
FIG. 20 is a schematic side view of a keyboard which includes key stroke detecting sensors for detecting stroke positions of depressed keys.

FIG. 20 shows by way of example the structure of the key stroke detecting sensor which detects stroke positions of the corresponding key. As known, the keyboard has white keys 21W and black key 21B, each of which is pivotable about a fulcrum or pivot 20 relative to a support member 29. A stroke sensor 22W for each white key 21W and a stroke sensor 22B for each black key 21B are fixed to the support member 29.

Once any of the white keys 21W is depressed, the corresponding white-key stroke sensor 22W detects the key stroke positions. Namely, as the white key 21W is depressed, a shutter plate 23W moves within the white-key stroke sensor 22W, which in turn provides output signals corresponding to varying positions of the moving shutter plate 23W.

The white-key stroke sensor 22W detects varying stroke positions of the white key 21W on the basis of amounts of light, emitted from a light source within the sensor 22W, passing through the shutter plate 23W. To this end, the shutter plate 23W is in the form of a gray scale which causes the amount of passed light to vary depending on the position of the shutter plate 23W.

In a similar manner, as any of the black key 2B is depressed, a shutter plate 23B moves within the corresponding black-key stroke sensor 22B, which in turn provides output signals corresponding to positions of the moving shutter plate 23B so as to detect varying stroke positions of the black key 21B.

A mass body 24 for each of the keys is movably supported with respect to the support member 29 so as to approximate a hammer mechanism of a natural piano. When a white key 21W is depressed, the white key 21W strikes a driven section 38W to transmit force to the corresponding mass body 24 via a shock absorber made of urethane rubber. When a black key 21B is depressed, the black key 21B strikes a driven section 38B to transmit force to the corresponding mass body 24 of the black key 21B via a shock absorber made of urethane rubber. The mass body 24 is caused by the force applied thereto to move relative to the support member 29.

The driven section 38B of each black key is located above the driven section 38W of each white key, so that the same key operation touch is obtained for both the white key and the black key.

Because each mass body 24 is designed to approximate a hammer mechanism of a natural piano, a light key touch is provided at the initial stage of depression of a white or black key 21W or 21B, and then the key touch gradually becomes heavier. Thus, the player can feel the same key operation touch as provided by a natural piano. With a weak key operation, variation in the key touch is slight and linear.

First and second contacts 37A and 37B for each key are fixed to the support member 29. The first contact 37A is first turned ON upon depression of the key, and then the second contact 37B is turned ON as the key is further depressed.

Figure 21A:
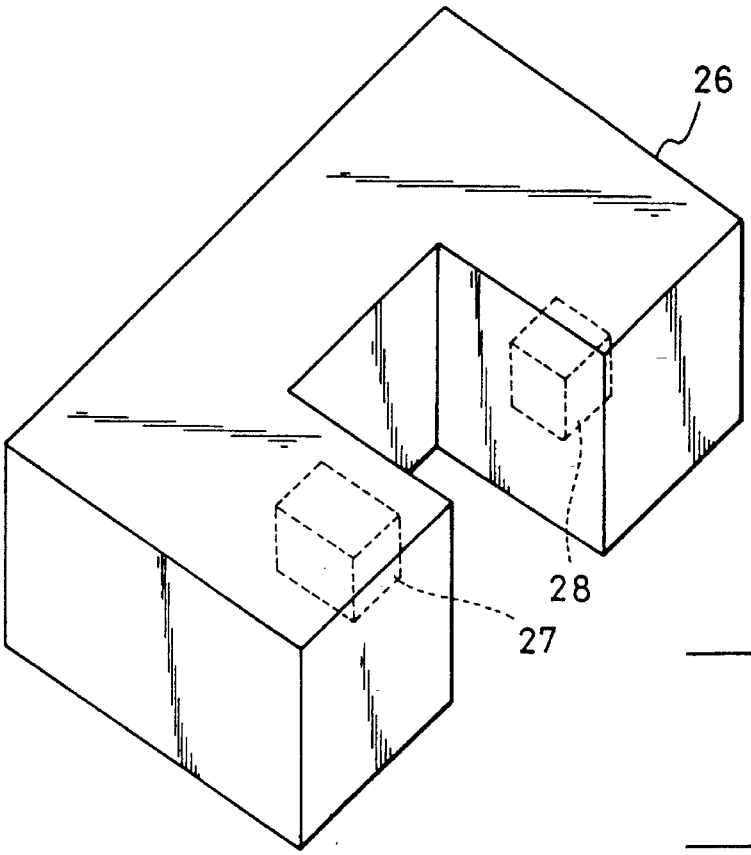
FIG. 21A is a schematic view showing a structural example of the key stroke detecting sensor.
Figure 21B:
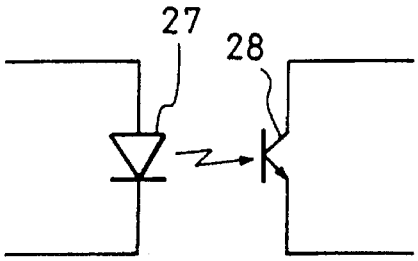
FIG. 21B is a diagram of electric circuitry employed in the structure of FIG. 21A.

FIG. 21A is a schematic perspective view showing the structure of the key stroke detecting sensor 26, which includes an LED (Light Emitting Diode) 27 and a phototransistor 28. As shown in FIG. 21B, light emitted from the LED 27 is received by the phototransistor 28, and electric current corresponding to the received light amount flows from it collector to emitter.

The LED 27 and phototransistor 28 are partitioned off from each other by the shutter plate. The shutter plate is in the form of a gray scale such that the amount of light received by the phototransistor 28 from the LED 27 via the shutter plate vary depending on the stroke position of the key.

In FIG. 20, the stroke sensing shutter plates 23W and 23B are provided for the white and black keys 21W and 21B, respectively, so as to detect respective positions of the white and black keys 21W and 21B relative to the support member 29.

Figure 22:
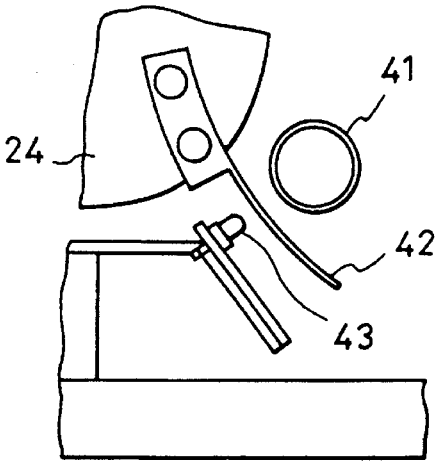
FIG. 22 is a schematic side view showing another structural example of the key stroke detecting sensor.

An example key stroke detecting sensor of FIG. 22 is different from that of FIG. 20 in that a detection is made of a relative position between the mass body 24 and the support member 29, and it includes a common light source 41, a shutter plate 42 movable in response to the movement of the key during depression, and a photo diode 43. The mass body 24 is movable relative to the support member 29 in response to the movement of the key during depression. A shutter plate 24 is secured to the mass body 24, and a common light source 41 and a photo diode 43 are secured to the support member.

Light emitted from the common light source 41 is passed through the shutter plate 42 to be irradiated onto the photodiode 43. The shutter plate 42 is in the form of a gray scale such that the amount of light irradiated on the photodiode 43 varies depending on the varying stroke positions of the key. In the photodiode 43 flows electric current corresponding to the amount of light, and hence the stroke positions of the keys can be detected on the basis of the electric current.

Figure 23:
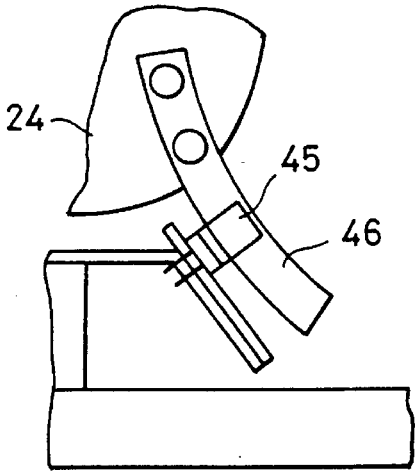
FIG. 23 is a schematic side view showing still another structural example of the key stroke detecting sensor.

FIG. 23 shows still another structural example of the key stroke detecting sensor, which, similarly to the example of FIG. 22, detects a relative position between the mass body 24 and the support member 29. This key stroke detecting sensor includes a shutter plate 46 and a photo interrupter 45. The shutter plate 46 is secured to the mass body 24, and the photo interrupter 45 is secured to the support member. The shutter plate 46 is movable, in response to the stroke of the key, between a light source and a light receiving element provided within the photo interrupter 45. The shutter plate 46 is in the form of a gray scale such that the amount of light flowing in the photo-interrupter 46 varies depending on the varying stroke positions of the key. Thus, the varying stroke positions of the keys can be detected on the basis of the varying electric current values.

Figure 24:
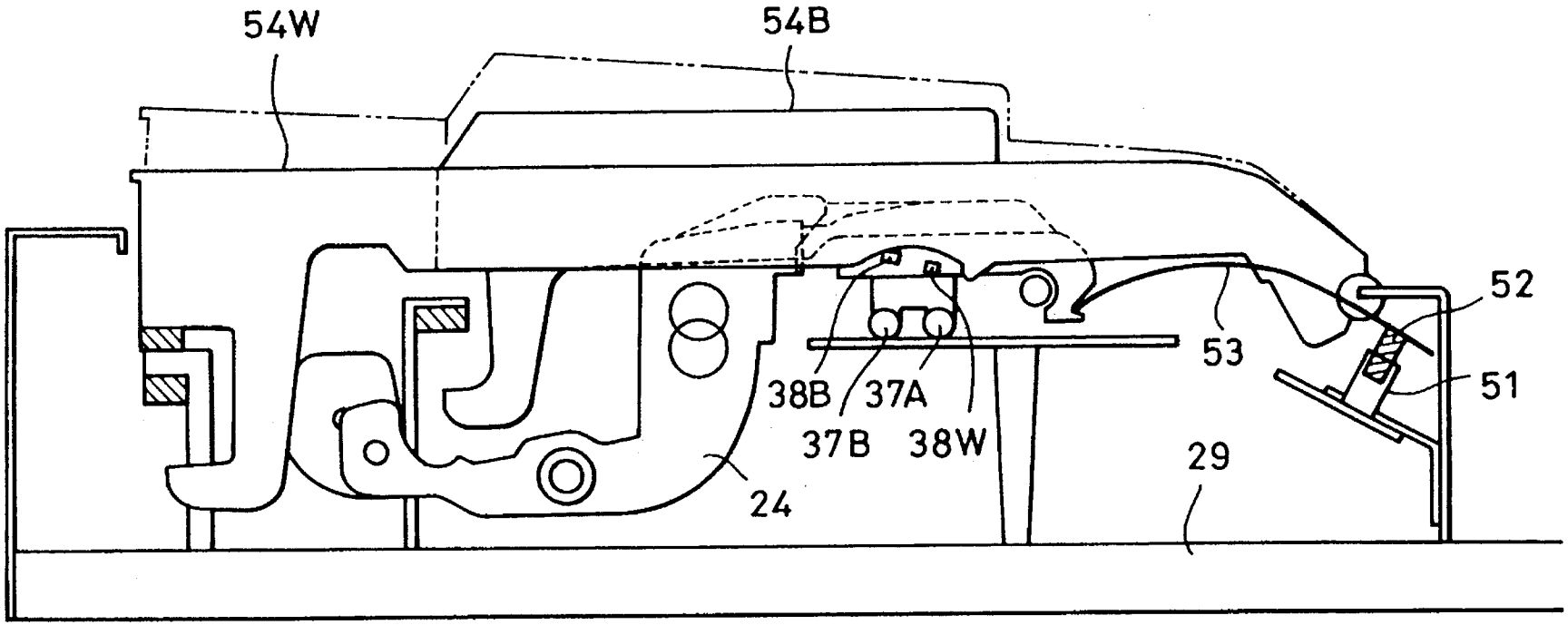
FIG. 24 is a schematic side view showing still another structural example of the key stroke detecting sensor.

FIG. 24 shows still another structural example of the key stroke detecting sensor. A spring 53 is bent by depression of a white or black key 54W or 54B and resilient force acts to return the depressed key back to the original position. In response to the bending of the spring 53, a shutter plate 52 moves between a light source and a light receiving element provided within a photo interrupter 51 fixed to the support member 29. The shutter plate 52 is in the form of a gray scale such that the amount of light flowing in the photo interrupter 51 varies depending on the varying stroke positions of the key. Thus, the varying stroke positions of the keys can be detected on the basis of the varying electric current values. Alternatively, a photo reflector may be used to detect the varying inclination of the spring 53 so that the stroke positions of the key is detected on the basis of the detected variation in the spring inclination.

The mass body 24 is supported for motion relative to the support member 29 and approximates a hammer mechanism of a natural piano.

When a white key 54W is depressed, the white key 54W strikes a driven section 38W to transmit force to the corresponding mass body 24 via a shock absorber made of urethane rubber. When a black key 54B is depressed, the black key 54B strikes a driven section 38B to transmit force to the corresponding mass body 24 of the black key 54B via a shock absorber made of urethane rubber. The mass body 24 is caused by the force applied thereto to move relative to the support member 29.

First and second contacts 37A and 37B for each key are fixed to the support member 29. The first contact 37A is first turned ON upon depression of the key, and then the second contact 37B is turned ON as the key is further depressed.

Figure 25:
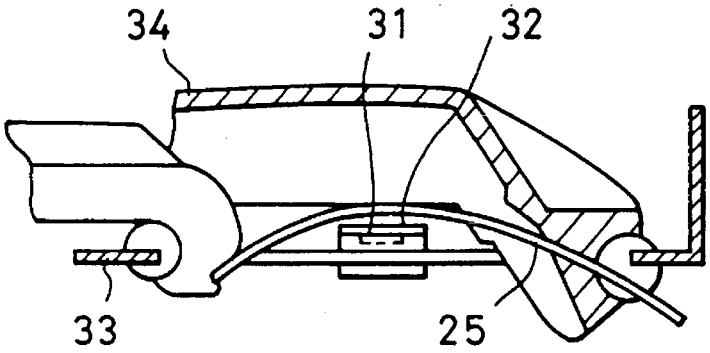
FIG. 25 is a schematic side view of the keyboard showing still another structural example of the key stroke detecting sensor.

FIG. 25 shows still another structural example of the key stroke detecting sensor. When a key 34 is depressed, a spring 25 supported by a support member 33 is bent, and resilient force acts to return the depressed key back to the original position. The stroke positions of the key can be detected on the basis of the bending of the spring 25. At this time, a sensor platform 32 for detecting the stroke positions of the white key is located above a sensor platform 31 for detecting the stroke positions of the black key.

Figure 26A:
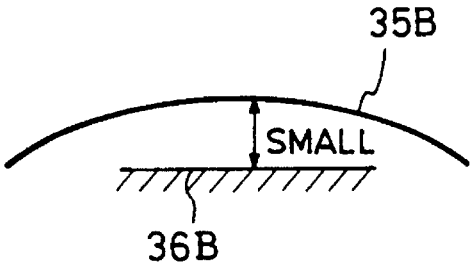
FIG. 26A is a schematic view showing the state of a spring when a black key is depressed.
Figure 26B:
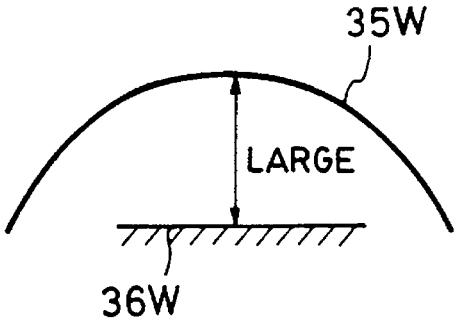
FIG. 26B is a schematic view showing the state of a spring when a white key is depressed.

FIGS. 26A and 26B show a difference between spring force when a white key is depressed and spring force when a black key is depressed. In FIG. 26A are shown the state of a spring 35B when a black key is depressed as well as a platform 36B for a sensor for detecting the stroke positions of the black key. In FIG. 26B are shown the state of a spring 35W when a white key is depressed as well as a platform 36W for a sensor for detecting the stroke positions of the white key. Here, assuming that the sensor platform 36B for the black key and the sensor platform 36W for the white key are at the same height, the spring for the white key is bendable to a greater degree than the spring for the black key, thus causing greater spring force. For this reason, it is necessary that the sensor platform 36W for the white key be positioned above the sensor platform 36B for the black key.

Figure 27:
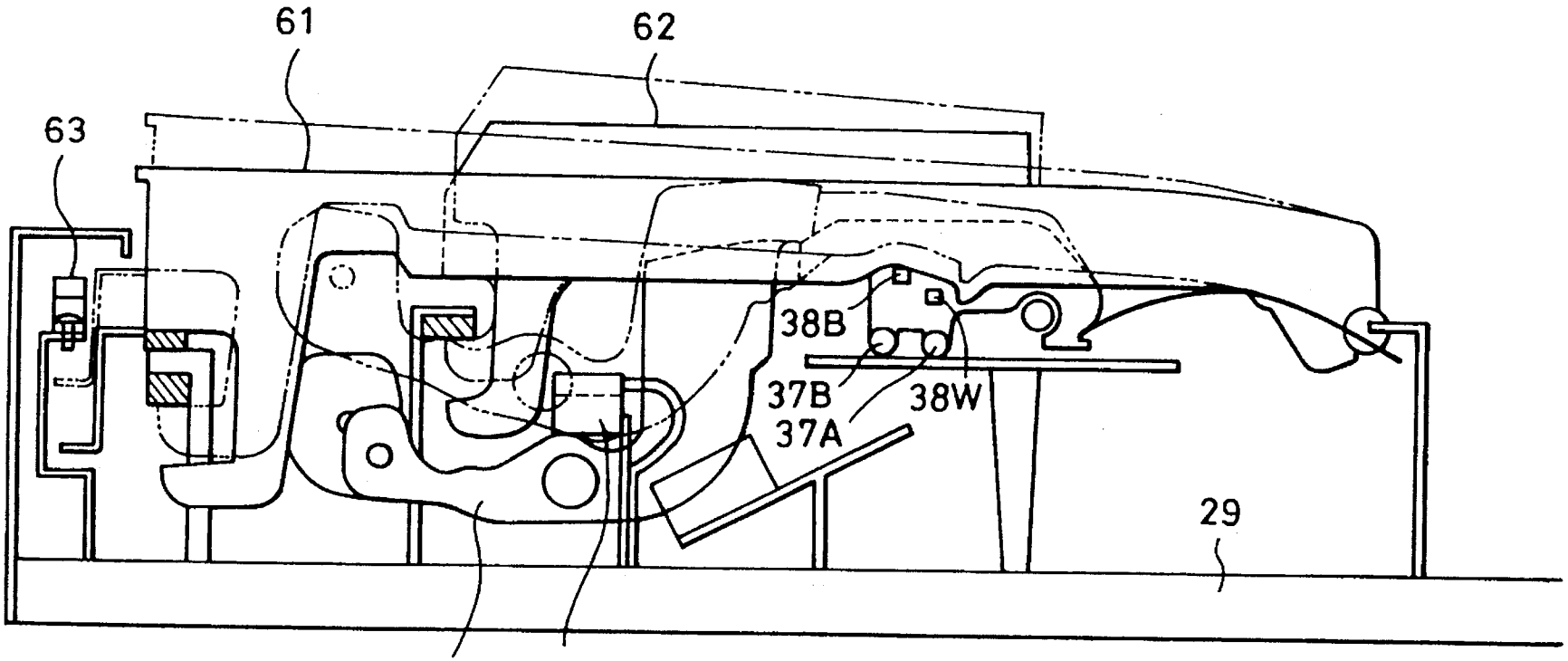
FIG. 27 is a schematic side view of the keyboard showing still another structural example of the key stroke detecting sensor.

FIG. 27 shows still another structural example of the key stroke detecting sensor. The stroke positions of a white key 61 are detected by a sensor 63, while the stroke positions of a black key 62 are detected by a sensor 64. The sensor 63 for the white key is a reflection-type sensor, which permits detection of the stroke positions of the white key by virtue of reflection change depending on the varying positions of the key. The sensor 64 for the black key is a reflection-type sensor, which permits detection of the stroke positions of the black key in a similar manner to the sensor 63.

When a white key 61 is depressed, the white key 61 strikes a driven section 38W to transmit force to a corresponding mass body 24 via a shock absorber made of urethane rubber. When a black key 62 is depressed, the black key 62 strikes a driven section 38B to transmit force to a corresponding mass body 24 via a shock absorber made of urethane rubber. The mass body 24 is caused by the force applied thereto to move relative to a support member 29.

First and second contacts 37A and 37B for each key are fixed to the support member 29. The first contact 37A is first turned ON upon depression of the key, and then the second contact 37B is turned ON as the key is further depressed.

It should be appreciated that, although the above-mentioned embodiments are designed to obtain key touch information from the stroke sensors, such key touch information may also be obtained from a force sensor for detecting a key depression force at a key depression termination position, or from such a force sensor which is provided on a hinge structure and detects a key depression force from the initial stage of the key depression.

According to the present invention as described above, a key operating style can be detected by detecting time-varying relative positions of a depressed key. This allows tones of different characteristics to be generated depending on a different performance style, and hence can highly enhance performance expression.

What is claimed is:

1. An electronic musical instrument comprising:

a plurality of keys moveably supported by a support member;

tone generation means for generating a tone corresponding to an operated one of said keys;

detection means for generating a detection signal indicating varying positions of said operated key as said operated key moves relative to said support member;

performance style determination means for determining a key operating style of said operated key by analyzing a degree of nonlinearity of time varying values of said detection signal; and tone control means for controlling said tone generation means in accordance with said key operating style determined by said performance style determination means.

2. An electronic musical instrument as defined in claim 1, wherein said detection means includes a plurality of stroke sensors disposed relative to said support member so that each of said stroke sensors detects a position of a corresponding key as said corresponding key moves relative to said support member.

3. An electronic musical instrument as defined in claim 1, wherein said performance style determination means includes velocity calculation means for calculating velocities of said operated key as said operated key moves relative to said support member on the basis of said position detection signal, and wherein said style determination means further includes analyzation means for determining said degree of nonlinearity on the basis of a plurality of said calculated velocities.

4. An electronic musical instrument as defined in claim 3, wherein said analyzation means includes interpolation means for generating a linear velocity pattern by interpolating between at least two of said velocities calculated by said velocity calculation means, and collation means for collating said linear velocity pattern with a pattern of velocities actually calculated by said velocity calculation means, and wherein said analyzation means determines said degree of nonlinearity on the basis of a deviation of said pattern of velocities actually calculated from said linear velocity pattern.

5. An electronic musical instrument as defined in claim 4, wherein said collation means determines a difference value between said linear velocity pattern and said pattern of velocities actually calculated by said velocity calculating means at each of a plurality of points in time.

6. An electronic musical instrument as defined in claim 5, wherein said collation means outputs an integrated value of said difference values.

7. An electronic musical instrument as defined in claim 5, wherein said collation means outputs a differential value of said difference values.

8. An electronic musical instrument as defined in claim 3, wherein said velocity calculation means successively obtains differential values of said position detection signal and outputs an average value of a predetermined number of said differential values as a velocity.

9. An electronic musical instrument as defined in claim 2, wherein said performance style determination means includes time measuring means for measuring a time during which said operated key moves from an initial stroke position to a predetermined intermediate stroke position, and said performance style determination means determines a key operating style of said operated key on the basis of said time measured by said time measuring means.

10. An electronic musical instrument as defined in claim 2, wherein said performance style determination means includes:

velocity calculation means for calculating velocities of said operated key as said operated key moves relative to said support member on the basis of positions detected by said stroke sensors, means for calculating differences between successive ones of said velocities calculated by said velocity calculation means, and time measuring means for measuring a time from a time point when movement of said operated key is initiated to another time point when a difference between successive velocities is greater than a predetermined value, and said performance style determination means utilizes said time measured by said time measuring means to analyze said degree of nonlinearity of said time varying values of said detection signal.

11. An electronic musical instrument as defined in claim 1 further comprising a mass body associated with said operated key such that said mass body is displaced as said operated key moves, and wherein said detection means includes a plurality of stroke sensors for detecting a position of said mass body relative to said support member.

12. An electronic musical instrument as defined in claim 1 wherein said tone control means controls said tone generation means in accordance with at least one factor selected from among volume, color and envelope in accordance with said operating style determined by said performance style determination means.

13. An electronic musical instrument as defined in claim 1, wherein said performance style determination means outputs digital data indicating said determined key operating style, and said tone control means controls a predetermined tone parameter in accordance with said digital data.

14. An electronic musical instrument as defined in claim 5, wherein said correlation means outputs a maximum of said difference values.

15. An electronic musical instrument comprising:

a plurality of keys pivotally supported by a support member;

tone generation means for generating a tone in response to operation of one of said keys;

a stroke sensor disposed relative to said operated key for detecting a position of said operated key as said operated key pivots relative to said support member;

performance style determination means for determining a degree of non-linearity in variations of said position of said operated key over time as said operated key is operated and determining a key operating style on the basis of said degree of nonlinearity; and tone control means for controlling said tone generation means in accordance with said operating style determined by said performance style determination means.

16. An electronic musical instrument comprising:

a keyboard including a plurality of keys;

tone generation means for generating a tone corresponding to an operated one of said keys;

first detection means for detecting a velocity of said operated key;

second detection means for generating a detection signal indicating varying positions of said operated key over time as said key is operated;

performance style determination means for determining a key operating style of said operated key on the basis of a degree of nonlinearity of said plurality of positions over time; and tone control means for controlling said tone generation means in accordance with said key operating style determined by said performance style determination means and said velocity determined by said first detection means.

17. An electronic musical instrument as defined in claim 16, wherein said first and second detection means include at least one sensor associated with each of said keys.

18. An electronic musical instrument as defined in claim 16, wherein said first and second detection means compose a common sensor for each of said keys.

19. An electronic musical instrument comprising:

a keyboard including a plurality of keys;

tone generation means for generating a tone corresponding to an operated one of said keys;

touch detection means for determining varying positions of said operated key as said operated key is operated;

performance style analyzation means for determining a key operating style of said operated key on the basis of a degree of nonlinearity of said plurality of positions detected by said detection means; and tone control means for controlling said tone generation means in accordance with said key operating style determined by said performance style analyzation means.

20. An electronic musical instrument comprising:

a keyboard including a support member, a plurality of keys pivotally supported by said support member, and a plurality of mass bodies corresponding to said keys, each of said mass bodies being displaced relative to said support member in response to movement of a corresponding key;

tone generation means for generating a tone corresponding to a key operated on said keyboard;

touch detection means for detecting a plurality of positions relative to said support member of a mass body corresponding to an operated key;

performance style analyzation means for determining a key operating style of said operated key on the basis of said plurality of positions detected by said touch detection means; and tone control means for controlling said tone generation means in accordance with said key operating style determined by said performance style analyzation means.

21. An electronic musical instrument as defined in claim 20, wherein said touch detection means includes stroke sensor means for detecting positions of each of said mass bodies relative to said support member as said keys are operated.

22. An electronic musical instrument as defined in claim 20, wherein said touch detection means includes force sensor means for detecting a force applied to said support member by a mass body corresponding to an operated key.

23. An electronic musical instrument as defined in claim 20, wherein said performance style analyzation means includes means for determining a degree of nonlinearity of said plurality of positions detected by said touch detection means and utilizing said determined degree of nonlinearity to determine said key operating style of said operated key.

24. An electronic musical instrument comprising:

a keyboard including a plurality of keys;

tone generation means for generating a tone corresponding to an operated key;

touch detection means for outputting a plurality of sequential information indicative of a touch applied to said operated key at predetermined intervals;

performance style determination means for detecting a maximum value of differential values of said touch information sequentially output from said touch detection means, and determining a key operating style of said operated key on the basis of said detected maximum value; and tone control means for controlling said tone generation means in accordance with said key operating style determined by said performance style determination means.

25. An electronic musical instrument as defined in claim 24 further comprising:

interpolation means for determining a linear pattern of touch information by interpolating between said sequential information output by said touch detection means at two different ones of said predetermined intervals, wherein said maximum value detected by said performance style determination means represents a maximum difference between said linear pattern and said plurality of sequential information indicative of a touch output by said touch detection means, whereby said maximum difference represents a degree of nonlinearity of said plurality of sequential information indicative of a touch output by said touch detection means.

26. An electronic musical instrument comprising:

a keyboard including a plurality of keys;

tone generation means for generating a tone corresponding to an operated key;

touch detection means for outputting a plurality of sequential information indicative of a touch applied to said operated key at predetermined intervals;

means for generating velocity information indicative of a a velocity of said operated key;

performance style analyzation means for determining a key operating style of said operated key on the basis of said touch information output from said touch detection means at a variable number of said predetermined intervals;

active control means for, in response to said velocity information, controlling said variable number of said predetermined intervals used by said performance style analyzation means to determine said key operating style of said operated key; and tone control means for controlling said tone generation means in accordance with said key operating style determined by said performance style analyzation means.

27. An electronic musical instrument as defined in claim 26, wherein said performance style analyzation means includes means for determining a degree of nonlinearity of said sequential touch information output by said touch detection means at said variable number of predetermined intervals and utilizing said determined degree of nonlinearity to determine said key operating style of said operated key.

28. An electronic musical instrument comprising:

a keyboard including a plurality of keys;

tone generation means for generating a tone corresponding to an operated one of said keys;

touch detection means for detecting a touch applied to said operated key and for outputting touch information indicative of said detected touch;

performance style determination means for, on the basis of said touch information output from said touch detection means, generating differential velocity data indicative of a plurality of velocities at predetermined time intervals of said key as said key is operated, and determining a key operating style for said operated key on the basis of an integrated value of said differential velocity data; and tone control means for controlling said tone generation means in accordance with said operating style determined by said performance style determination means.

29. An electronic musical instrument as defined in claim 28 further comprising:

interpolation means for determining a linear pattern of touch information by interpolating between said touch information output by said touch detection means at two different points in time, wherein said integrated value determined by said performance style determination means represents a sum of differences at a plurality of points in time between said linear pattern of touch information and said touch information output by said touch detection means, whereby said integrated value represents a degree of nonlinearity of said touch information output by said touch detection means.

* * * * *